US012110785B2

(12) United States Patent
Burgess et al.

(10) Patent No.: US 12,110,785 B2
(45) Date of Patent: Oct. 8, 2024

(54) SYSTEM AND METHOD FOR MONITORING MOTION OF DOWNHOLE TOOL COMPONENTS OF A DRILLING SYSTEM

(71) Applicant: APS Technology, LLC, Wallingford, CT (US)

(72) Inventors: Daniel E. Burgess, Portland, CT (US); Allen Kopfstein, Pittsfield, MA (US)

(73) Assignee: APS Technology, LLC, Wallingford, CT (US)

( * ) Notice: Subject to any disclaimer, the term of this patent is extended or adjusted under 35 U.S.C. 154(b) by 697 days.

(21) Appl. No.: 16/689,700

(22) Filed: Nov. 20, 2019

(65) Prior Publication Data

US 2020/0157932 A1 May 21, 2020

Related U.S. Application Data

(60) Provisional application No. 62/769,853, filed on Nov. 20, 2018.

(51) Int. Cl.

| | |
|---|---|
| ***E21B 47/07*** | (2012.01) |
| ***E21B 7/00*** | (2006.01) |
| ***E21B 44/00*** | (2006.01) |

(52) U.S. Cl.

CPC ..... *E21B 47/07* (2020.05); *E21B 7/00* (2013.01); *E21B 44/00* (2013.01)

(58) Field of Classification Search

None

See application file for complete search history.

(56) References Cited

U.S. PATENT DOCUMENTS

| | | | | |
|---|---|---|---|---|
| 7,377,339 | B2 | 5/2008 | Wassell et al. | |
| 7,389,830 | B2 | 6/2008 | Turner et al. | |
| 10,938,390 | B2 * | 3/2021 | Camacho Cardenas | G01R 27/28 |
| 2011/0198126 | A1 * | 8/2011 | Swietlik | E21B 17/07 175/320 |
| 2012/0103689 | A1 * | 5/2012 | Hutchinson | E21B 44/00 175/55 |
| 2013/0119246 | A1 * | 5/2013 | Pai | E21B 47/135 250/208.2 |
| 2015/0218934 | A1 * | 8/2015 | Turner | E21B 47/02 175/45 |
| 2015/0300841 | A1 * | 10/2015 | Campbell | E21B 47/007 310/68 B |
| 2016/0032709 | A1 * | 2/2016 | Ledroz | E21B 47/022 73/152.54 |
| 2017/0362910 | A1 * | 12/2017 | Stephens | E21B 33/143 |
| 2019/0257972 | A1 * | 8/2019 | Palmer | G01V 1/42 |
| 2019/0326906 | A1 * | 10/2019 | Camacho Cardenas | F04D 29/086 |

* cited by examiner

*Primary Examiner* — Lina Cordero

(74) *Attorney, Agent, or Firm* — Offit Kurman, P.A.; Gregory A. Grissett

(57) ABSTRACT

A drilling system tool including at least one sensor configured to detect movement of one or more components of the drilling system tool. The sensor is configured to operate at high pressures and temperatures typical in the drilling environment downhole. The sensors are suitable for vibration damping tools, rotary steerable motors systems, downhole motors, drill bits, or other similar downhole drilling equipment that includes a movable component.

45 Claims, 18 Drawing Sheets

SYSTEM AND METHOD FOR MONITORING MOTION OF DOWNHOLE TOOL COMPONENTS OF A DRILLING SYSTEM

CROSS-REFERENCE TO RELATED APPLICATIONS

The application claims the benefit of and priority to U.S. Provisional Application No. 62/769,853, filed Nov. 20, 2018, the entire disclosure of which is incorporated by reference into this application for all purposes.

TECHNICAL FIELD

The present disclosure relates to systems and methods for monitoring motion of downhole tool components in a drilling system.

BACKGROUND

Drilling systems for underground drilling operations are complex and difficult to monitor and control. The drilling environment is harsh. The bottom hole assembly (BHA), which typically includes a drill bit, downhole motor, measurement-while-drilling (MWD) tools, a telemetry system, and possibly a directional drilling tool (e.g. rotary steerable system), is exposed to significant forces and elevated temperatures during the drilling operation. BHA components are ruggedly constructed so that sensitive monitoring equipment, such as sensors, controllers, and other electronics can withstand repeated and prolonged exposure to the high pressures and temperatures typical in the downhole drilling environment.

However, the drilling environment limits the type of sensors that can be used in downhole tools and how the data obtained from those sensors can be transmitted uphole. Sensors suitable for the harsh drilling conditions typically have lower data acquisition rates compared to other types of sensors. Telemetry systems commonly used in well drilling, such as mud-pulse and acoustic telemetry systems, have low data transmission rates. But work continues in developing more robust and reliable ways to obtain data downhole and improve tool health.

SUMMARY

An embodiment of the present disclosure is a drilling system tool including at least one sensor configured to detect movement of one or more components of the drilling system tool. The sensor is configured to operate at high pressures and temperatures typical in the drilling environment downhole. In a few examples, the sensors as described herein are suitable for vibration damping tools, rotary steerable motor systems, downhole motors, drill bits, or other similar downhole drilling equipment that includes a movable component.

An additional embodiment of the present disclosure is a tool assembly configured to be carried by a drill string that is configured to define a borehole in an earthen formation during a drilling operation. The tool assembly includes a first member and a second member that is moveable relative to the first member during the drilling operation. The tool assembly further includes a sensor module coupled to the first member. The sensor module includes at least one proximity sensor spaced from the second member so that the second member is within a detectable range of the at least one proximity sensor, wherein the at least one proximity sensor is configured to detect information indicative of movement of the second member relative to the first member. The tool assembly further includes a computer processor in electronic communication with the at least one proximity sensor. The computer processor is configured to, in response to information indicative of movement of second member relative to the first member, determine a position of the second member relative to the first member.

Another embodiment of the present disclosure is a tool assembly for a drill string that is configured to define a borehole in an earthen formation during a drilling operation. The tool assembly includes a first member elongated along a central axis and a second member that is moveable relative to the first member during a drilling operation. The second member is moveable in response to vibration of a drill bit coupled to a downhole end of the drill string. The tool assembly further includes a sensor module coupled to the first member. The sensor module includes a set of proximity sensors spaced apart from the second member in a direction perpendicular to the central axis. Each sensor is configured to detect information indicative of the distance between the sensor and the second member. The tool assembly further includes a temperature sensor configured to measure temperature proximate the sensing module. The tool assembly further includes a pressure sensor configured to measure the pressure proximate the sensing module. The tool assembly further includes a computer processor configured to, in response to information indicative of the distance between the set of sensors and the second member, the measurement of the temperature, and the measurement of the pressure, determine a position of the second member relative to the first member.

Another embodiment of the present disclosure is a method for determining relative positions of components of a downhole tool along a drill string configured to drill a borehole into an earthen formation. The method includes detecting, via a plurality of proximity sensors mounted to a first component of the downhole tool, the presence of a second component of the downhole tool within a detection range of the plurality of sensors. The method further includes determining, via a computer processor in electronic communication with the plurality sensors, a distance from each sensor to a detection portion of the second component. The method further includes determining a position of the second component relative to the first component based on the distance between the plurality of sensors and the detection portion of the second component.

A further embodiment of the present disclosure is a rotary steerable motor system. The rotary steerable motor system includes a housing that defines a plurality of pockets. The rotary steerable motor system further includes a plurality of moveable pads at least partially disposed the plurality of pockets, respectively, and each moveable pad is operable to move between a first position and a second position relative to the housing. The rotary steerable motor system further includes a plurality of proximity sensors supported by the housing and adjacent to the plurality pockets, respectively, each proximity sensor having a detection range that extends into the respective pocket, wherein each sensor is configured to detect presence of the movable pad within the detection range. The rotary steerable motor system further includes a computer processor configured to determine, based on the information that is indicative of the presence of the moveable pad within the detection range of the proximity sensor, the amount the moveable pad moves.

Another embodiment of the present disclosure is a compensation assembly. The compensation assembly includes a mandrel defining a passage configured to permit drilling mud to flow through the mandrel. The compensation assembly further includes a sliding compensation piston positioned around the mandrel, the compensation piston having a downhole side configured to contact the drilling mud and an uphole side. The compensation assembly further includes a housing configured to include at least one proximity sensor, the at least one proximity sensor having a detection range. The compensation assembly further includes a computer processor configured to determine the onset of a condition when the at least one proximity sensor detects a portion of the piston entering the detection range of the at least one sensor.

Another embodiment of the present disclosure is a system that includes a housing, a torsional spring at least partially positioned inside the housing, and at least one proximity sensor configured to obtain data indicative of acceleration. The system includes a reaction mass coupled to the torsional spring and positioned in the housing. The system further includes a computer processor configured to, in response to information from the sensor module and the reaction mass, determine a torsional acceleration of the housing.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings, illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Embodiments of the present disclosure include systems and methods for monitoring various downhole tools and assemblies, such as vibration damping systems, directional drilling tools, and related components thereof, such as compensation assemblies. More specifically, embodiments of the present disclosure relate to a control and monitoring system that includes at least one computing device and one or more proximity sensors that detect motion of a component of a drilling system tool during a drilling operation.

A proximity sensor as used herein is configured to detect the presence of nearby objects without any physical contact to the object. For instance, the proximity sensor may be configured to emit an electromagnetic field or a beam of electromagnetic radiation (infrared, for instance), and look for changes in the field or return signal. Proximity sensors may include a capacitive proximity sensor, photoelectric sensor, or an inductive proximity sensor. In one preferable example, the proximity sensors are eddy current sensors configured to operate in the downhole environment. Eddy current sensors as described herein utilize the principle of eddy current formation to sense displacement. Eddy currents are formed when a moving or changing magnetic field intersects a conductor or vice versa. The relative motion causes a circulating flow of electrons, or currents, within the conductor. The circulating eddies of current create electromagnets with magnet fields that oppose the effect of the applied magnetic field. Without being bound by any particular theory, the stronger the applied magnetic field, or greater the electrical conductivity of the conductor, or greater the relative velocity of motion, the greater the currents developed and greater the opposing field. Eddy current sensors as described herein sense the formation of secondary fields to determine the distance between the sensor face and target material. While eddy current sensors are preferred, other proximity sensors may be used as described above. The proximity sensor is operable when exposed to a temperature range between approximately 0 degrees centigrade and approximately 200 degrees centigrade. Additionally, the proximity sensor is operable when subject to pressure between approximately 1000 BAR and approximately 1700 BAR. In one embodiment, the proximity sensor may be pressure rated up to approximately 1000 BAR. In another embodiment, the proximity sensory may be pressure rated up to approximately 1700 BAR. The proximity sensor may have a frequency response of at least 1 Khz.

Figure 1:
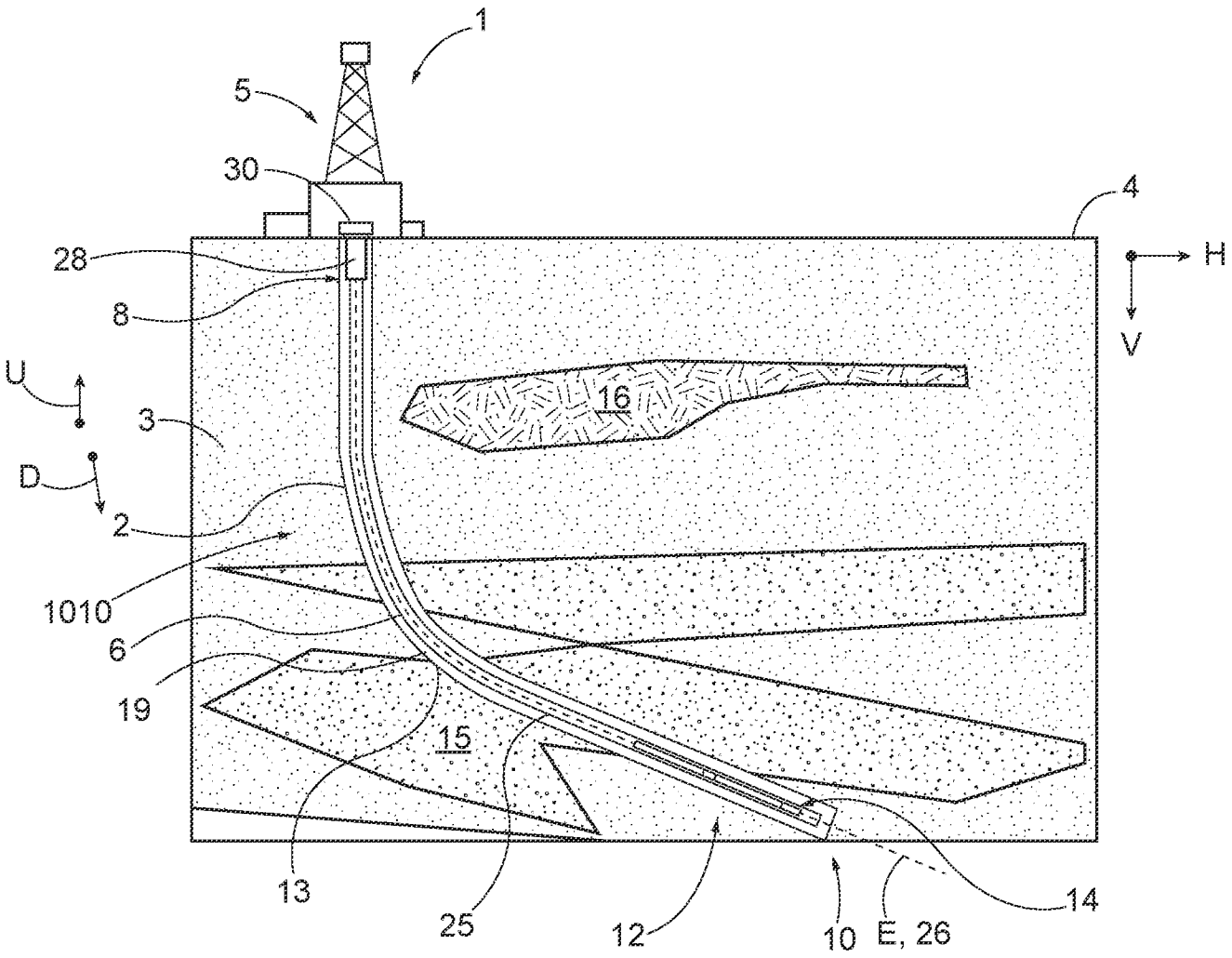
FIG. 1 is a schematic side view of a drilling system according to an embodiment of the present disclosure.

Referring to FIG. 1, the drilling system 1 is configured to drill a borehole 2 in an earthen formation 3 during a drilling operation. The drilling system 1 includes a drill string 6 for forming the borehole 2, a surface control system 30, one or more downhole control systems (e.g. control system 200 shown in FIG. 8*a*), and a telemetry system (not numbered). The drilling system 1 also includes a derrick 5 that supports the drill string 6, one or more blow preventer (BOP) positioned over the bore hole at the surface, and a casing 28 extends into the formation 3 in the downhole direction D. One or more motors, such as a top drive or rotary table, are configured to rotate the drill string 6, the drill bit 14, or both so as to control the rotational speed (RPM) of, and torque on, the drill bit 14. For instance, a surface motor can apply torque to the drill string while a downhole motor can rotate the drill bit independent of rotation of the drill string. A pump is configured to pump the drill mud (pump and fluid not shown) downward through the internal passage (not shown) in the drill string 6. When the drill mud exits the drill string 6 at the drill bit 14, the returning drilling mud flows upward toward the surface 4 through an annular passage formed between the drill string 6 and a wall (not numbered) of the earthen formation 3 that defines the borehole 2. Optionally, a mud motor may be disposed at a downhole location of the drill string 6 to rotate the drill bit 14 independent of the rotation of the drill string 6.

Continuing with FIG. 1, the drill string 6 is elongated along a central longitudinal axis 26 and includes a top end 8 and a bottom end 10 spaced from the top end 8 along the central longitudinal axis 26. The drill string 6 also extends along a longitudinal direction (not numbered) that is aligned with the central longitudinal axis 26. The drill string 6 and its multiple components define the drill string 6 and the internal passage (not numbered) through which drill mud travels in a downhole direction D. The drill string 6 is formed of several components that include drill string tubulars, MWD tool (not numbered), a vibration damping tool or system 12, and/or a rotary steerable motor 1010 or other directional tools. The telemetry system includes one or more receivers located near the surface, and a telemetry tool typically located downhole that transmits drilling information between the downhole control systems and the surface control system 30

As can be seen in FIG. 1, the drilling system 1 is configured to drill the borehole 2 in an earthen formation 3 along a borehole axis E such that the borehole axis E extends at least partially along a vertical direction V. The vertical direction V refers to a direction that is perpendicular to the surface 4 of the earthen formation 3. It should be appreciated that the drill string 6 can be configured for directional drilling, whereby all or a portion of the borehole 2 is angularly offset with respect to the vertical direction V along an offset direction H. The offset direction H is mostly perpendicular to the vertical direction V so as to be aligned with or parallel to the surface 4. The terms "offset", "horizontal" and "vertical" used herein, are as understood in the drilling field, and are thus approximations. Thus, the offset direction H can extend along any direction that is perpendicular to the vertical direction V, for instance north, east, south and west, as well as any incremental direction between north, east, south and west. Further, downhole or downhole location means a location closer to the bottom end of the drill string 6 than the top end of the drill string 6. Accordingly, a downhole direction D (FIG. 2) refers to the direction from the surface 4 toward a bottom end (not numbered) of the borehole 2, while an uphole direction U (FIG. 2) refers to the direction from the bottom end of the borehole 2 toward the surface 4. The downhole and uphole directions D and U can be curvilinear for directional drilling operations. Thus, the drilling direction or well path extends partially along the vertical direction V and the horizontal direction H (FIG. 1) in any particular geographic direction as noted above.

Figure 2:
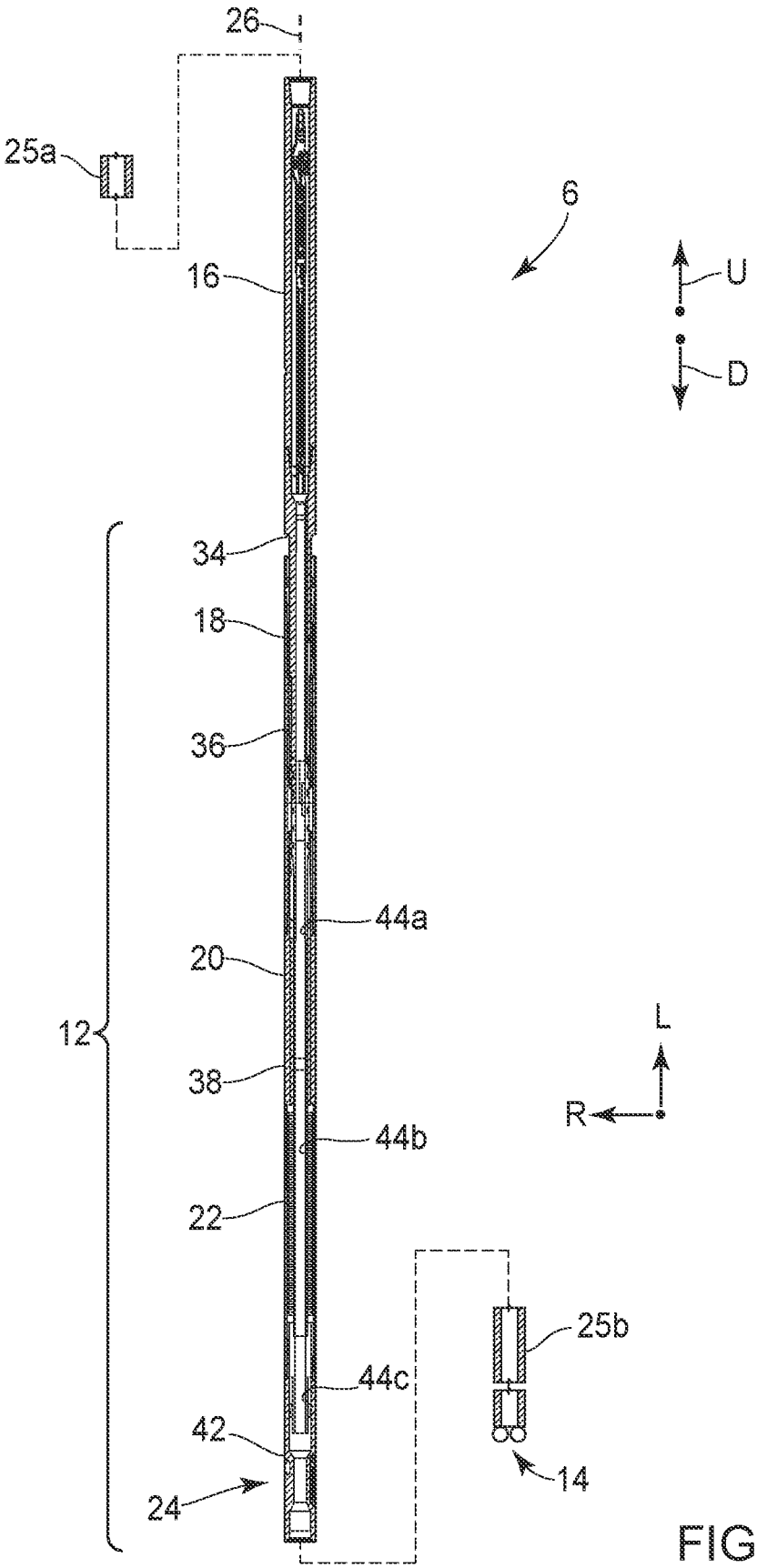
FIG. 2 is a sectional view of a portion of a bottomhole assembly of a drill string in the drilling system shown in FIG. 1.

FIGS. 2-14 depict a vibration damping system 12 installed along a bottom hole assembly of a drill string. Referring to FIG. 2, the vibration damping system 12 can be used as part of a drill string 6, to dampen vibration of a drill bit 14 located at a down-hole end of the drill sting 6 (see FIG. 1). An exemplary vibration damping system is described in U.S. Pat. No. 7,377,339 (the "339 patent"), the entire disclosure of which is incorporated by reference into this application.

Figure 3A:
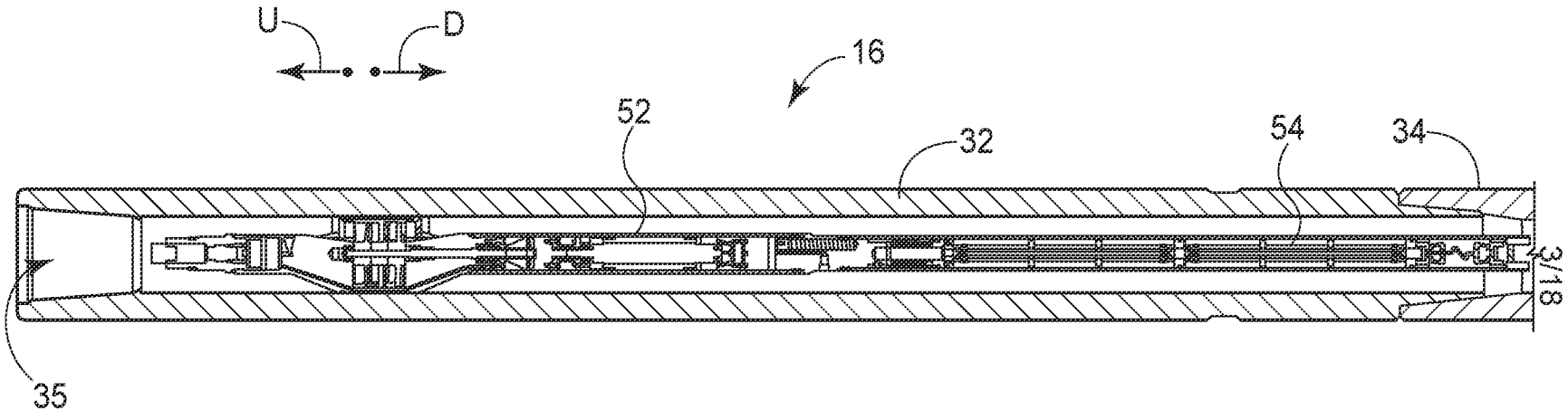
FIG. 3A is a sectional view of a portion of the bottomhole assembly shown in FIG. 2.
Figure 3B:
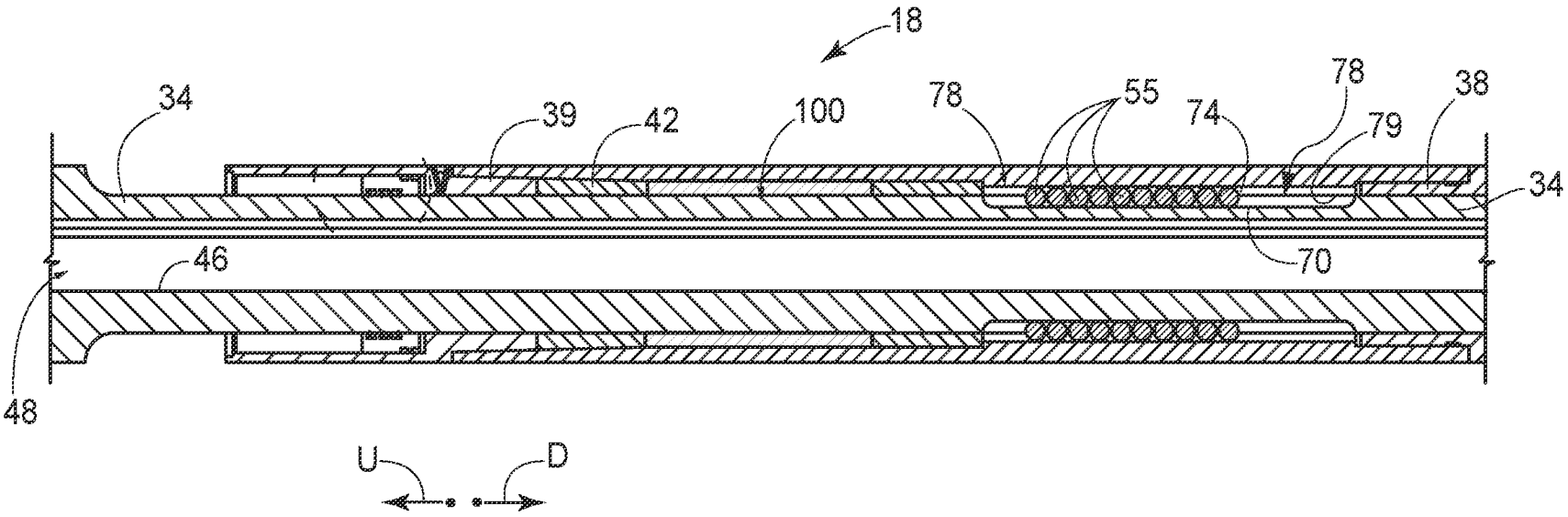
FIG. 3B is a sectional view of a downhole portion of the bottomhole assembly shown in FIG. 2, illustrating an outer member, inner member and a sensor housing carried by the outer member.
Figure 4:
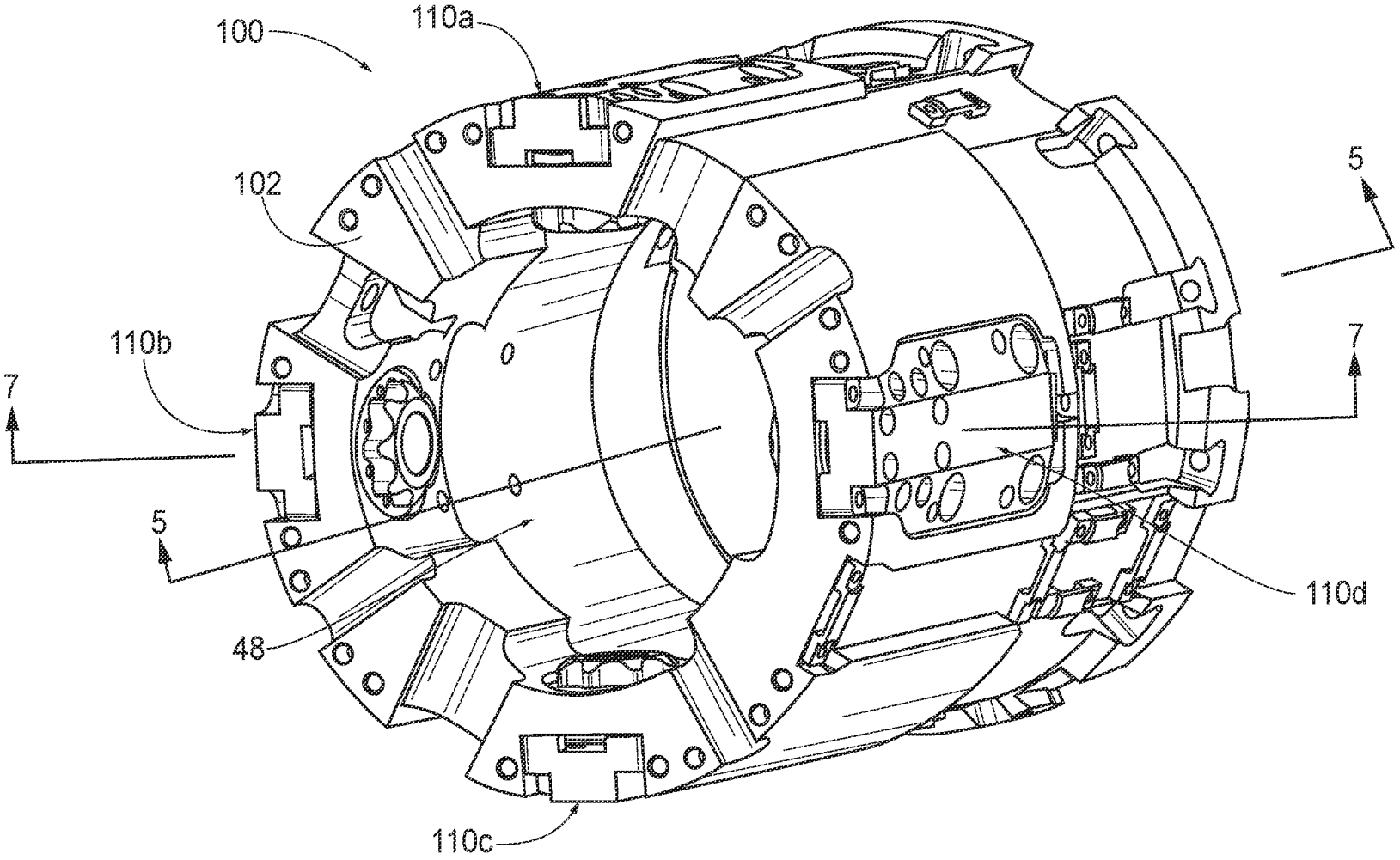
FIG. 4 is a perspective end view of the sensor housing shown in FIG. 3B.
Figure 5:
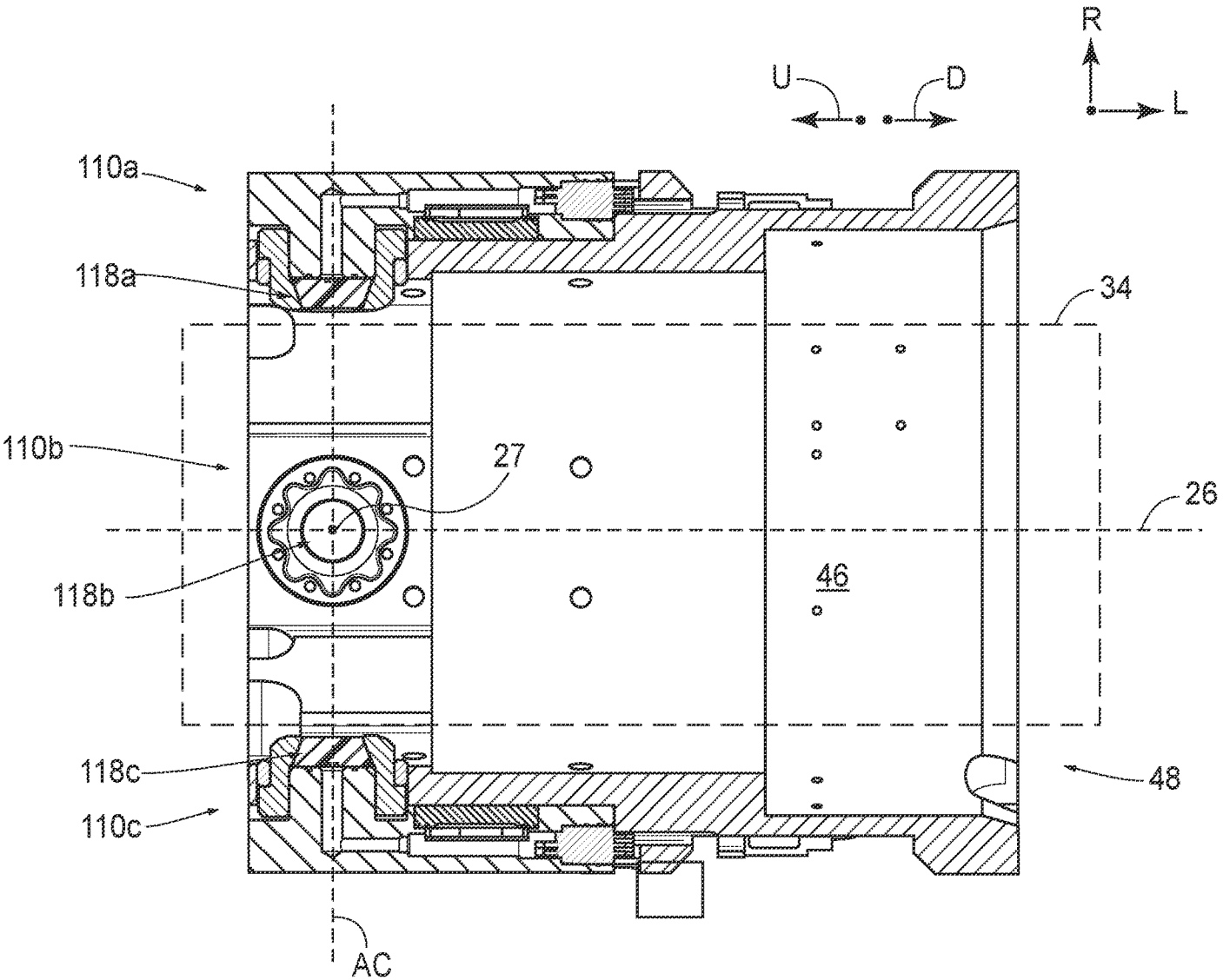
FIG. 5 is a cross-sectional view of the sensor housing taken along line 5-5 in FIG. 4.

Continuing with FIGS. 2-3B, the downhole portion of the drill string 6 includes a power section 16, the vibration damping system 12, and the drill bit 14, and multiple sections of casing that define an outer surface of the drill string 6. As illustrated, drill pipe 25*a* located uphole of the power section 16 transmits drilling torque to an outer casing 32 of the power section 16. The outer casing 32 is coupled to a mandrel 34 so that the drilling torque is transferred from the power section 16 to the mandrel 34. The mandrel 34 therefore rotates with movement of the outer casing 32. Although not shown FIG. 2, a downhole end of mandrel 34 is coupled to the drill bit 14. Furthermore, outer casings 36, 38, 42 encase the vibration damping system 12 and are coupled together end-to-end. The casing 36 is slidably disposed along the mandrel 34 and is fixed to an uphole end (not numbered) of the casing 38. An uphole end (not numbered) of casing 42 is fixed to the casing 38 and the downhole end (not numbered) of casing 42 is fixed to the downhole section of the drill collar 25*b* and the drill bit 14. The mandrel 34 extends from the outer casing 32 into the outer casings 36, 38 and 42 toward the drill bit 14. Further, each casing 36, 38, and 42 are slidably disposed along mandrel 34. Configured in this manner, the mandrel 34 is configured to translate along an axial direction L relative to the outer casings 36, 38, and 42.

Referring to FIG. 3A, the outer casing 32 houses a power section 16 and a control system 52. The power section 16 can include any suitable power source 54. As shown, the power source is a turbine-alternator. In another example, the power source 54 is a battery pack. The outer casing defines an internal passage 35 through which drilling fluid passes through downhole toward the drill bit 14. The control system (not shown) is configured to control operational aspects of vibration damping system 12. The power source 54 and control system 52 are also contained within protective housings (not numbered) disposed in the internal passage 35.

Turning to FIGS. 2 and 3B, the vibration damping system 12 comprises a torsional bearing assembly 18 supported in part by the casing 36, a valve assembly 20 supported by a casing 38, and a spring assembly 22 supported by the casing 42. The torsional bearing assembly 18 can facilitate transmission of drilling torque, while permitting relative axial movement between the portions of the drill sting 6 located up-hole and down-hole of the vibration damping system 12. Moreover, the torsional bearing assembly 18 can transform torsional vibration of the drill bit 14 into axial vibration. The axial vibration, in turn, can be damped by the valve assembly 20 and the spring assembly 22. The valve assembly 20 and the spring assembly 22 can produce axial forces that dampen vibration of the drill bit 14. The magnitude of the damping force can be varied by the valve assembly 20 in response to the magnitude and frequency of the vibration, on a substantially instantaneous basis, as described in the 339 patent.

Continuing with FIG. 3B, the torsional bearing assembly 18 comprises the outer member or casing 36, an inner member or the mandrel 34, and a sensor assembly 100. The casing 36 and the mandrel 34 are disposed in a substantially coaxial arrangement, with the mandrel 34 located within the casing 36. The mandrel 34 is supported within the casing 36 by a radial bearing (not numbered) that allows the casing 36 to translate axially in relation to the mandrel 34. Grooves 74 formed in the casing 36 and grooves 70 formed in the mandrel define a passage 78 which contain ball bearings 55. The ball bearings 55 can transmit torque between the mandrel 34 and the bearing casing 36. The ball bearings 55 can be, for example, rock bit balls (other types of ball bearings can be used in the alternative).

As shown in FIG. 3B, the torsional bearing assembly 18 also includes the sensor assembly 100 positioned to detect the relative displacement between the mandrel 34 and the casing 36 in the axial direction and/or displacement of mandrel 34 relative to the casing 36 along a radial direction R that is perpendicular to the axial direction L. As illustrated, the sensor assembly 100 is positioned uphole with respect to the bearings 55. A retainer 39 holds the sensor assembly 100 in place. The casing 38 defines an inner passage through which the mandrel 34 extends.

Continuing with FIGS. 4-7, the sensor assembly 100 includes a plurality of sensor modules 110, with each sensor module 110 including a proximity sensor 118, such as an eddy current sensor. In the present disclosure, reference number 110 identifies a sensor module and may be used with reference numbers 110*a*, 110*b*, 110*c*, and 110*d*. In addition, reference number 118 identifies a sensor and may be used with reference numbers 118*a*, 118*b*, 118*c*, and 118*d*. As illustrated, the sensor assembly 100 includes a mounting body 102 in the form of a ring. The mounting body 102 includes an inner surface 46 that defines a central passage 48 that receives the mandrel 34 (shown in dashed lines in FIG. 5). The outer surface (not numbered) can be mounted to an inner surface of casing 36. The mounting body 102 can be formed of multiple parts or it can be a monolithic part. Alternatively, the mounting body 102 can be defined in part by the outer casing 36. The mounting body 102 also includes a plurality of recesses 108 (FIG. 6) each receiving a respective sensor module 110.

Figure 6:
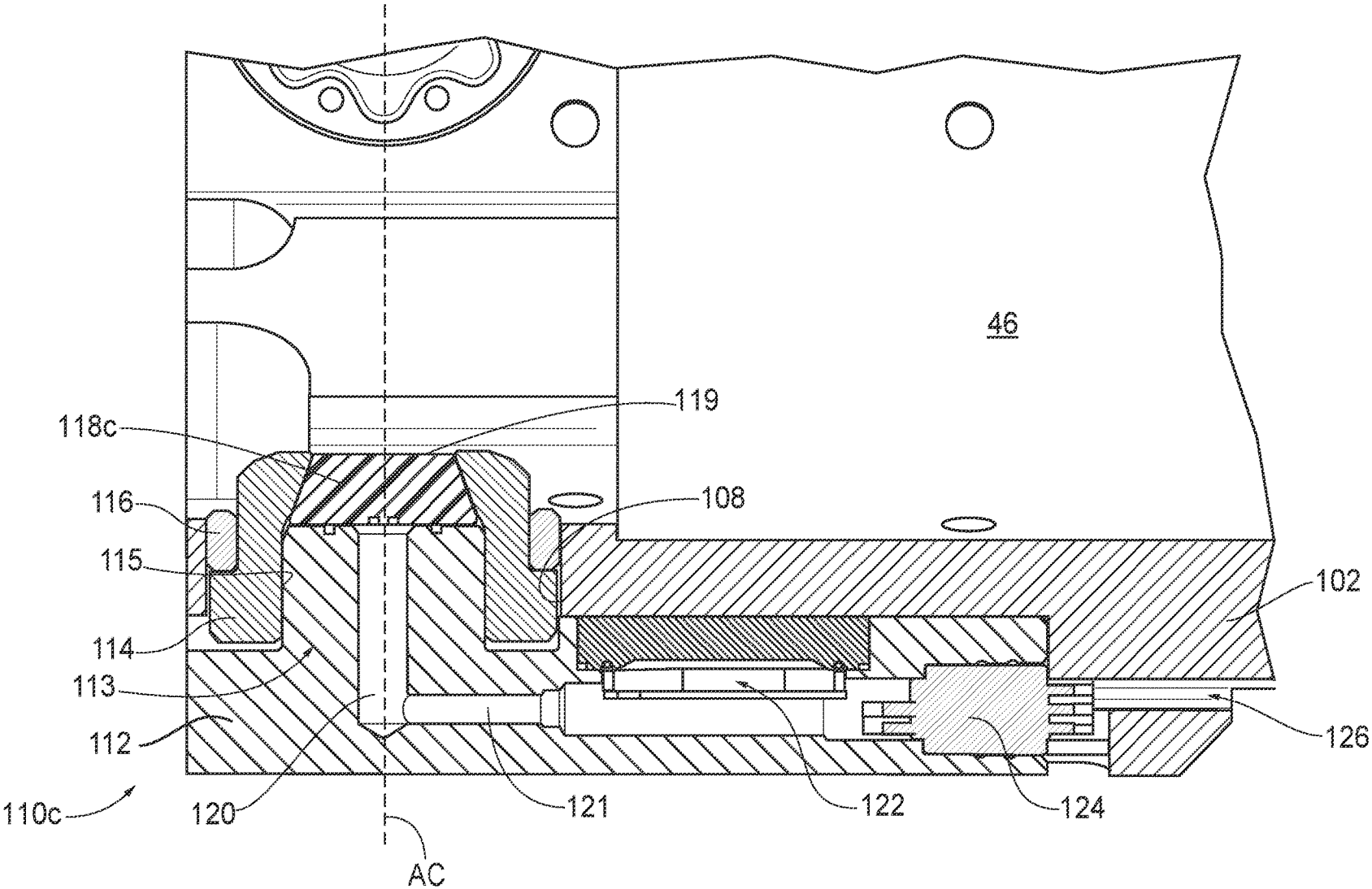
FIG. 6 is a detailed cross-sectional view of a portion of the sensor housing shown in FIG. 5.
Figure 7:
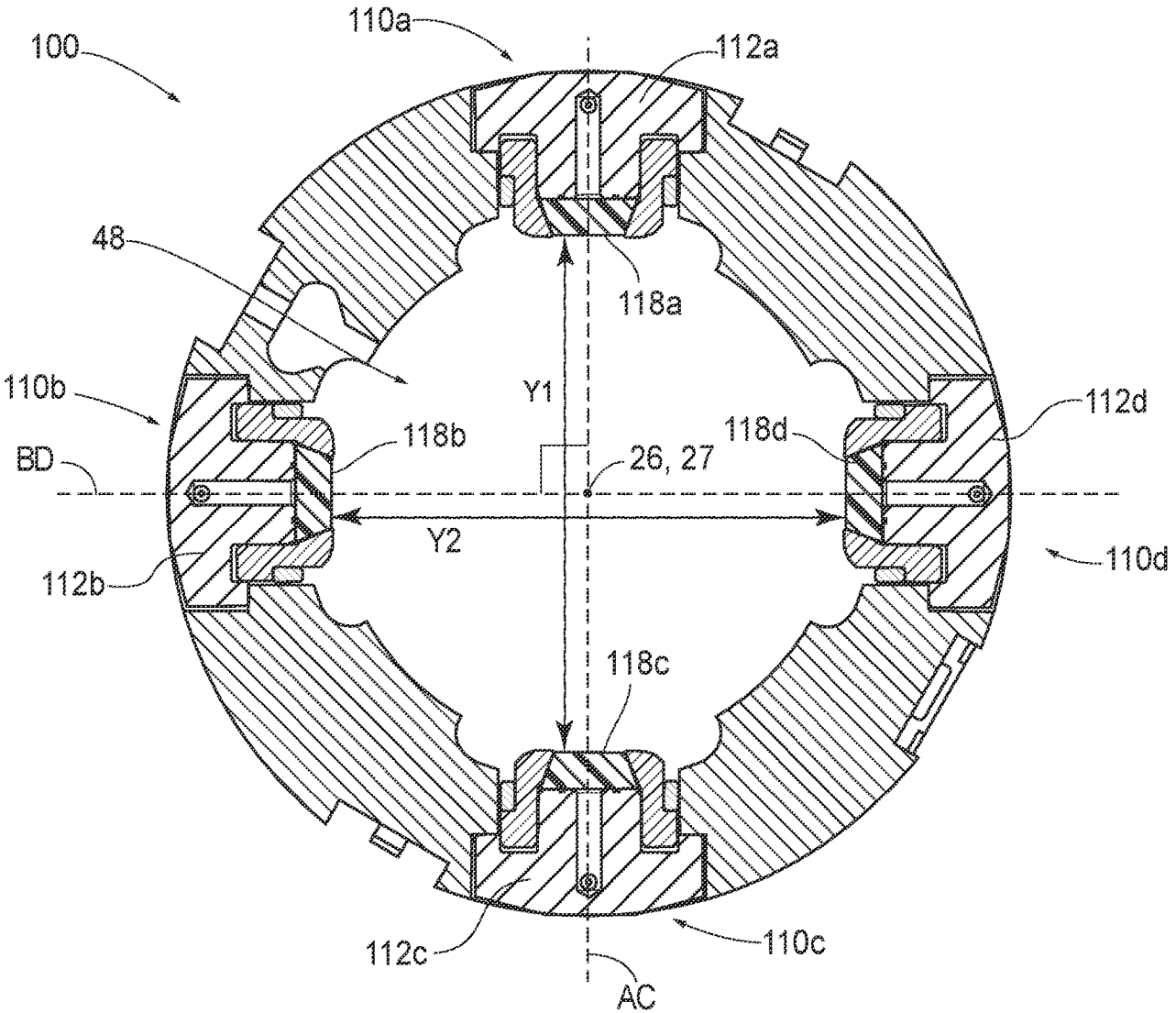
FIG. 7 is a cross-sectional view of the sensor housing taken along line 7-7 in FIG. 4.
Figure 14:
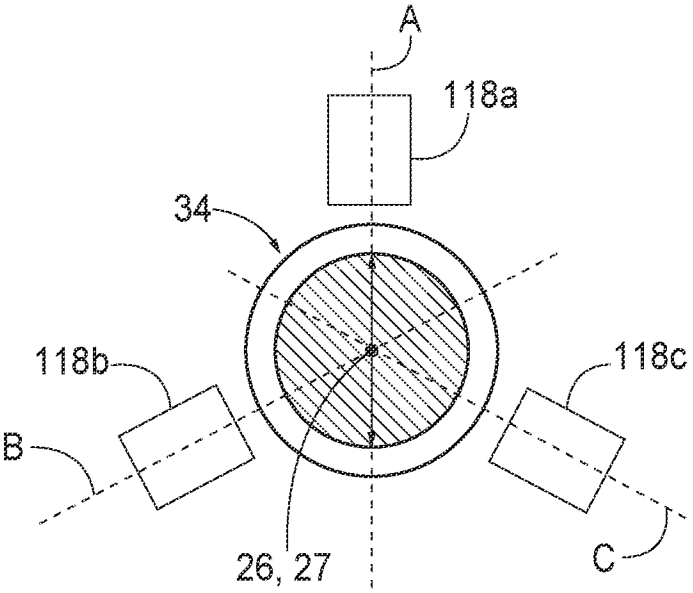
FIG. 14 is a schematic diagram illustrating an end view of an inner member and sensors carried by the sensor housing shown in FIGS. 4-7, according to an alternative embodiment of the present disclosure.

As illustrated in FIGS. 4-7, the sensor assembly 100 includes at least one sensor module 110*a*. As illustrated in the drawings, the sensor assembly 100 includes four sensor modules 110*a*, 110*b*, 110*c*, and 110*d* that are circumferentially spaced apart about axis 26. In the present disclosure, reference number 110 may be used interchangeably with reference numbers 110*a*, 110*b*, 110*c*, and 110*d*. The sensor modules 110*a* and 110*c* are aligned along axis AC and sensor modules 110*b* and 110*d* are aligned along axis BD. Axes AC and BD intersect with each other and the axis 26 intersects at point 27. Opposing sensors are spaced apart a known distance Y. As illustrated in FIG. 7, the faces of sensors 118*a* and 118*c* are spaced apart a known distance Y1 that extends through point 27, and the faces of sensors 118*b* and 118*d* are spaced apart a known distance Y2 that extends through point 27. The arrangement illustrated in FIGS. 4-7 is referred to as a quad array. While four sensor modules 110 are shown, one, two, three or more than four sensor modules 110 can be used. For example, FIGS. 11A-12B illustrate a two-sensor array while FIG. 14 illustrates a three sensor array 14. The section of the mandrel 34 axially aligned with the sensor assembly 100 can be tapered, either in the uphole or downhole direction. In still other alternative embodiments, the mandrel 34 can be tapered in both the uphole or downhole directions, as shown in FIG. 13.

Referring to FIG. 6, each sensor module 110 includes a sensor housing 112, a sensor 118 positioned on an inward side (not numbered) of the housing 112, and one or more pressure and temperature sensors (not shown). The sensor module 110 also includes a retainer 114 and a retainer nut 116. The housing 112 defines passages 120 and 121 for holding wires that extend to the PCB 24 which includes controller components. The pressure header 124 is positioned in passage 121 and is exposed to the external surface of the mounting body 102. A passage 126 extends from the pressure header 124 along the mounting body 102. The retainer 114 and nut 116 secure the sensor 118 to the housing 112. The housing 112 can secured to the mounting body 102 via connectors (not shown). The pressure and temperature sensors can be connected to the electronic components of PCB 24. The pressure and temperatures sensor may be used to account for pressure or temperature effects on data acquisition downhole.

Each sensor 118 is carried by the housing 112 and has a nominal detecting range that extends into the passage 48. In one embodiment, the nominal detection range can be up to 8.0 mm. In another example, the nominal detection range can be up to 6.0 mm. In another example, the nominal detection range can be up to 4.0 mm. In another example, the nominal detection range can be up to 2.0 mm. In another example, the nominal detection range can be between 2.0 mm and 6.0 mm. When the nominal detection range is referred to as being up to a given value, such as 8.0 mm, the range is between a minimum non-zero value, such as 0.005 mm, and the stated maximum value. As illustrated, an outer surface of the mandrel 34 can fall within the nominal detection range of at least one sensor.

Each sensor 118 produces an electrical output that is a function of the position of the mandrel 34 in relation to the sensors 118*a* through 118*d*. The sensor assembly 100 thereby can provide an indication of the relative axial positions of the bearing casing 36 and the mandrel 34, such as between the positions shown in FIGS. 9B and 9C, and/or radial positions of the mandrel 34 with respect to the bearing casing 36, as shown in FIGS. 10A and 10B. Moreover, the rate of change of the output is a function of the rate of change in the relative positions of the sensor 118 and the mandrel 34. Hence, the sensors 118 can provide an indication of the relative axial displacement, velocity, and acceleration of the bearing casing 36 and the mandrel 34. The sensors 118*a*-118*d* are configured to obtain position data for the inner mandrel 34 relative to the casing 36. The position data is relayed to the processor of a control system 200, which determines the radial distance from the face of each sensor 118 to an outer surface of the mandrel 34 along a radial direction R that is perpendicular to the central axis 26. The computer processor is further configured to determine a cross-sectional dimension of the inner mandrel 34 based on the radial distances between each respective proximity sensor 118*a*-118*d* and the mandrel.

Figure 8A:
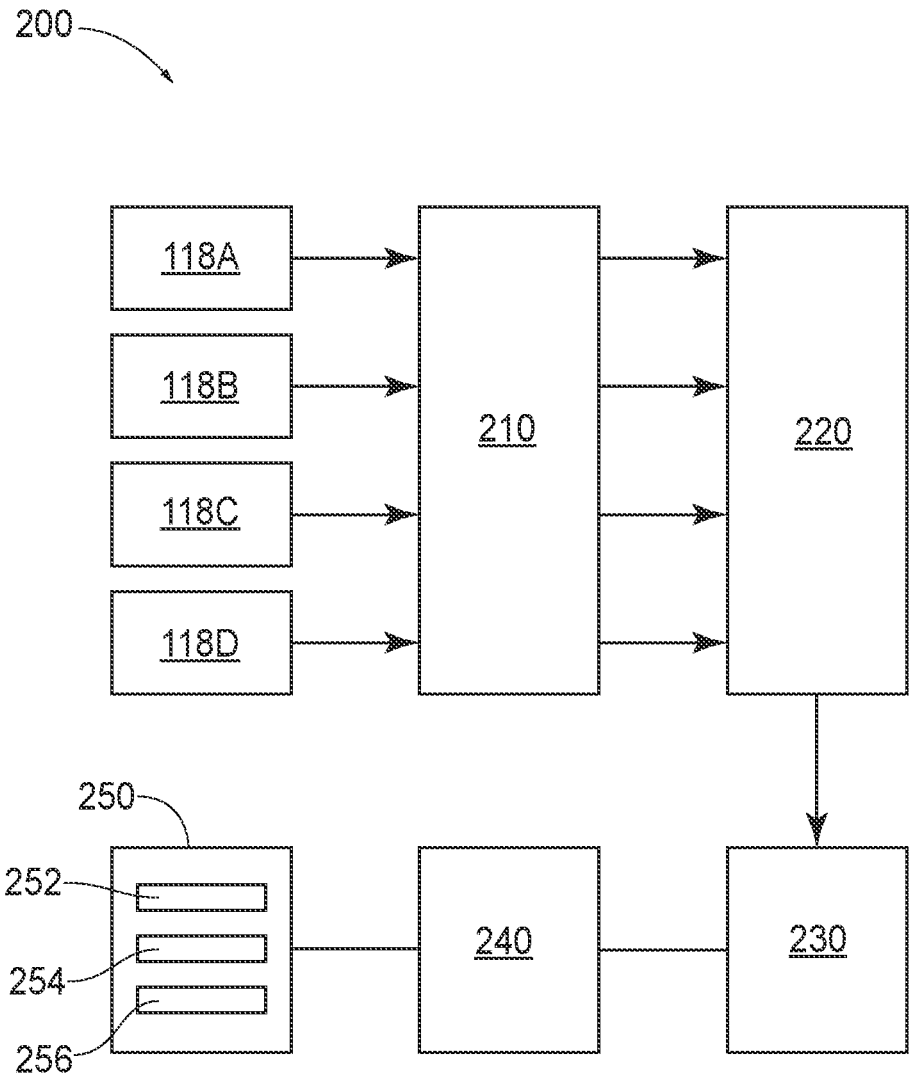
FIG. 8A is schematic block diagram of a monitoring system including the sensors shown in FIGS. 4-7.
Figure 8B:
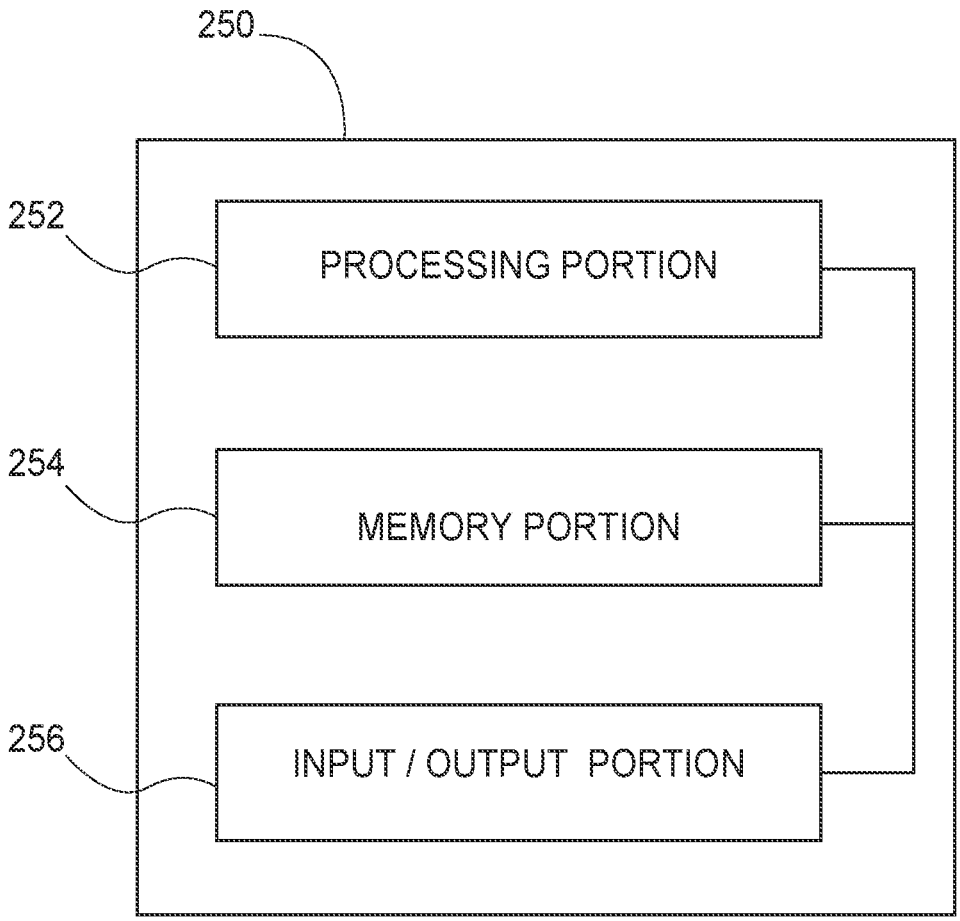
FIG. 8B is a schematic of an exemplary controller configured as a computing device, used in the monitoring system illustrated in FIG. 8A.

Turning to FIG. 8A, the damping system 12 can include a monitoring and control system 200 configured to control operation of sensor modules 110 and process data. As illustrated, the system 200 includes sensors 118*a*, 118*b*, 118*c*, and 118*d*, a first converter 210, and second converter 220, a microcontroller or computing device 230, and a transceiver 240 in communication with a master controller or computing device 250 for the vibration damping system 12. The first converter 210 can be configured as a pulse width modulation (PWM)/DC converter and includes four channel receivers (not shown) in electronic communication with each respective sensor 118*a*, 118*b*, 118*c*, and 118*d*. The output of the converter 210 is applied to the second converter 220. The second converter 220 is configured as an A/D converter, e.g. a quad Delta-Sigma A/D converter. The second converter 220 receives signals from each channel in the converter 210, where they are simultaneously sampled, digitized and sent, in bit-serial format, to the microcontroller 230. The microcontroller 230 reformats the received digital data and sends the result to the transceiver 240 for transmission to the master controller 250. The master controller 250 can be configured as a computing device and includes a processing portion 252, a memory portion 254, and an input/output portion 256. It is emphasized that the block diagram depiction of the computing device 250 is exemplary and not intended to imply a specific implementation and/or configuration. The processing portion 252, memory portion 254, and input/output portion 256 are coupled together to allow communications therebetween. In addition, the microcontroller 230 can also include a processing portion, a memory portion, and an input/output portion that are not illustrated in FIG. 8A. As should be appreciated, any of the above components may be distributed across one or more separate devices and/or locations along a drill string.

In accordance with the embodiment illustrated in FIGS. 2-13, the master control system 200 controls the operation of the damping system 12 in order to dampen vibration of the drill bit 14 as needed. In general, the sensor assembly 100 obtains position data, and provides an input to the computing device 250, via components on the system shown in FIG. 8A, in the form of an electrical signal indicative of the relative axial position, velocity, and acceleration of the casing and the mandrel 34, as noted above. As described herein, the casing is connected to the drill bit 12, and is substantially decoupled from axial movement of the mandrel 34. Hence, the output of the sensors—obtained position data of the mandrel—is indicative of the magnitude and frequency of the axial vibration of the drill bit 14. In one embodiment, the computer executable instructions, when executed by the processor 252, can determine the optimal amount of damping at a particular operating condition, based on the position data obtained from the sensors 118*a*-118*b*. Furthermore, the processor 252 can determine power required to provide the desired damping as described in the 339 patent. In one embodiment, the vibration damping system 12 is configured to automatically increase or decrease the amount of damping exerted on the drill bit 14 to reduce vibration of the drill bit 14 in response to changes in position of the mandrel 34.

Figure 9B:
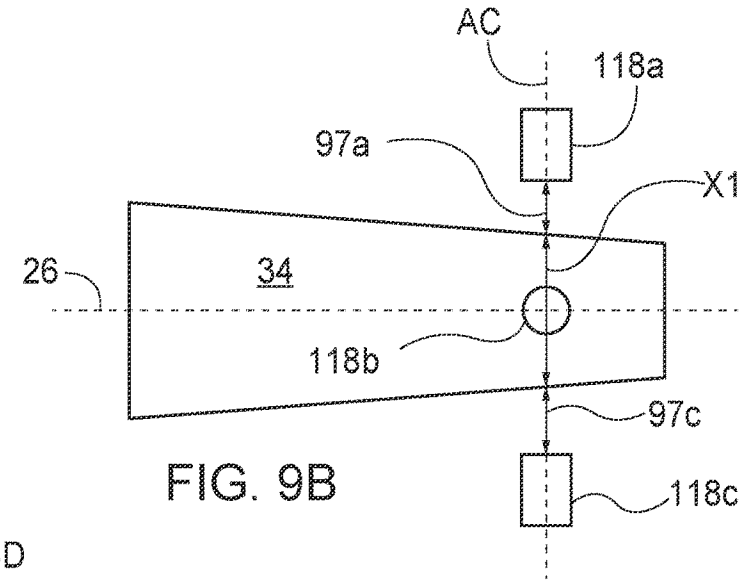
FIG. 9B is a schematic diagram illustrating a side view of the inner member and sensors shown in FIG. 9A, illustrating the inner member in a first axial position.
Figure 9C:
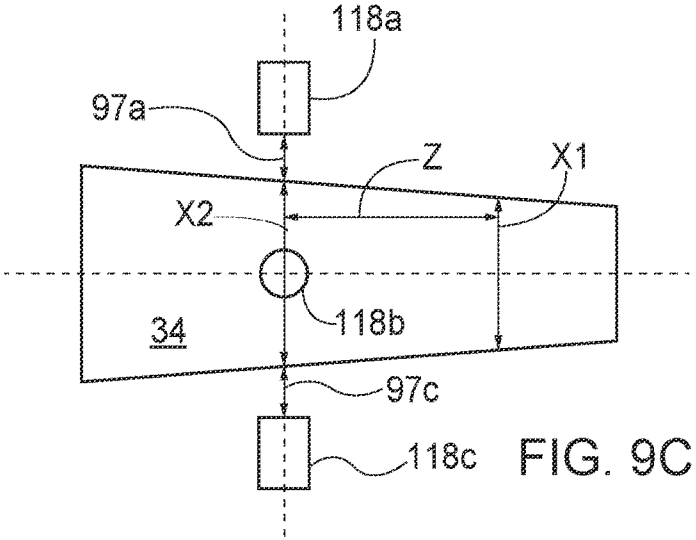
FIG. 9C is a schematic diagram illustrating a side view of the inner member and sensors shown in FIG. 9B, illustrating the inner member in a second axial position.
Figure 9A:
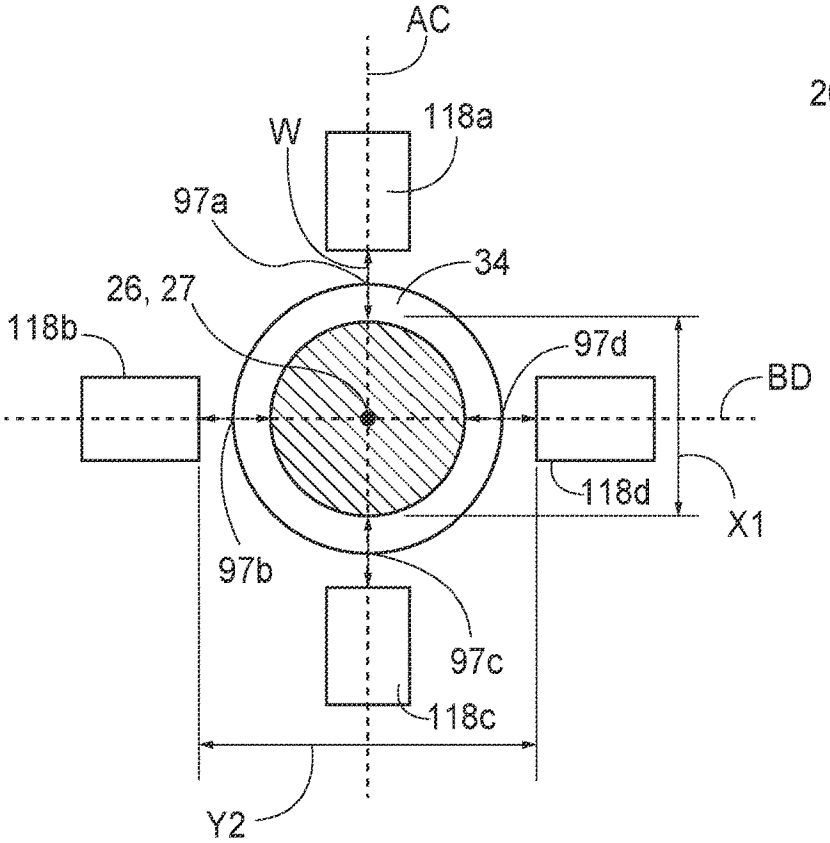
FIG. 9A is a schematic diagram illustrating an end view of an inner member and a plurality of sensors carried by the sensor housing shown in FIGS. 4-7.
Figure 10A:
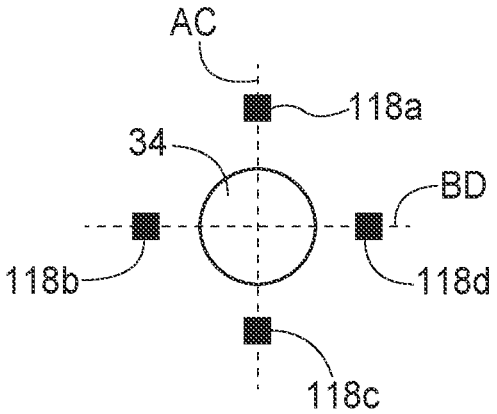
FIGS. 10A and 10B are schematic diagrams of end views of the inner member and sensors carried by the sensor housing shown in FIGS. 4-7, illustrating radial displacement of the inner member relative to the sensors.
Figure 10B:
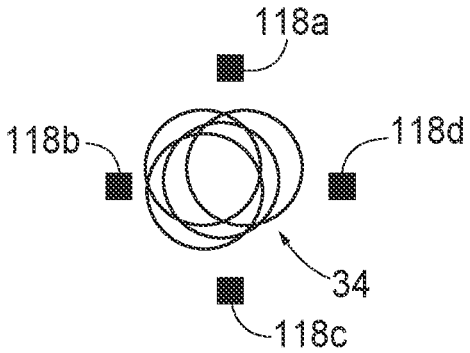

Referring to FIGS. 7 and 9A-9B, the system 200 is configured to obtain reliable position data regarding the mandrel 34 while drilling. During drilling, the bottom hole assembly is subjected to high pressures and temperatures typical in the drilling environment downhole. When the drill bit 14 is rotating and cutting into the formation, the drill bit 14 and the mandrel 34 are undergoing random axial motions and some level of radial oscillation response to forces applied the drill bit 14, such as weight-on-bit, and other forces. The mandrel position in the casing 32, including axial position and/or radial position, can be based on A) a derived value for the mandrel diameter and/or, B) based on sensor outputs regarding the mandrel in combination with various coefficients, such as linearity, pressure and temperature coefficients, as will be explained below. Each embodiment for obtaining mandrel position will be described below.

In an embodiment where mandrel position is based on derived values of mandrel diameter X (method "A"), the processor 1) determines radial offsets for the mandrel 34 from a center, and 2) a distance W between each sensor 118 and the mandrel 34 along sensor axes AC and BD. Referring to FIGS. 9A-9C, by determining the distance W between each sensor and the outer surface of the mandrel 34, the mandrel diameter X of the conically tapered mandrel 34 can be obtained. The gap or distance W is the distance from the sensor face to the mandrel. The distance W is denoted as 97*a*-97*d* for each respective sensor in FIGS. 9A and 9B and 98*a*-98*b* for each respective sensor in FIG. 9C. As the mandrel advances in the axial direction L, the sensors 118*a*-118*b* obtain updated data sets regarding mandrel diameter, which can be used to determine axial displacement. For instance, in the case of quad array as shown in FIG. 9A, because opposing sensors are spaced apart a known distance Y, the distances 97*a*-97*d* between sensor faces and outer surface the mandrel 34 are indicative of mandrel diameter X. For instance, when the mandrel 34 is in a first axial position as shown in FIG. 9B, the diameter X1 of the mandrel 34 can be determined based on the measured distances 97*a*-97*d* between the faces of sensors 118*a*-118*d* and the outer surface of the mandrel 34. And when the mandrel 34 is advanced along axial directional L into the second position as shown FIG. 9C, the diameter X2 of the mandrel 34 can be determined based on the measured distances 97*a*-97*d* between the faces of sensors 118*a*-118*d* and the outer surface of the mandrel 34 at that location. Given a known relationship between X1 and X2 (e.g. the degree of taper of mandrel 34), the displacement distance Z the mandrel 34 has advanced can be derived using known techniques. By sampling data at high rates using sensors 118 as described herein, the change in axial position (e.g. the extent of "Z" fluctuation) of the mandrel over time can be derived as well.

In operation, each sensor 118*a*-118*d* detects the outer surface of the mandrel 34 when the mandrel is within the nominal detecting range of the sensors. The temperature sensor obtains a measurement of the temperature in proximity of the sensor module 110. The pressure sensor obtains a measurement of the pressure in proximity of the sensor module 110. The controller 230 can determine if each one of the sensors 118*a*-118*d* is operational. The controller 230 (processor) determines the actual distance from each face of sensors 118*a*-118*d* to the outer surface (or central axis) of the mandrel 34. For instance, for sensor 118*a*, in response to the detection of the mandrel within the detection range of the sensor 118*a*, the controller 230 executes instructions to determine the actual distance 97*a* between a face of the sensor 118*a* and the outer surface of the mandrel along axis AC. For sensor 118*c*, in response to the detection of the mandrel within the detection range of the sensor 118*c*, the controller 230 executes instructions to determine the actual distance 97*c* between a face of the sensor 118*c* and the outer surface of the mandrel along axis AC. Similar measurements are made for remaining sensors 118*b* and 118*d*. Because the distances Y (shown as Y1 and Y2 in FIG. 7) between each opposed sensors 118*a* and 118*c* and between 118*b* and 118*d* are known, the diameter of the mandrel 34 can be determined and any radial offset corrections applied as needed. The radial offsets of mandrel 34 can be determined by adding displacement vectors along axis AC and axis BD. The obtained data result becomes a data address from which a mandrel diameter X can be obtained, for instance, in an 8-bit format. As noted above, the determination of the actual distance may be corrected based on the temperature and pressure of sensor assembly, as well as any linearity of the sensor 118*a*. The corrections can be based on a stored look-up table that compensates a measured distance between a sensor 118*a* based on temperature and pressure and determined radial offset of the mandrel, if present. Other temperature and pressure correction methods are possible.

In accordance with another embodiment of where mandrel position is based on derived values of mandrel diameter X (method "A"), the mandrel diameter X at a given point in time can be obtained by a) determining the mandrel center using radial displacement vectors, and b) calculating the diameter X based on compensated sensor data. The radial displacement vector indicates the displacement of the mandrel center relative to the intersection 27 of the orthogonal measurement axes AC and BD. To obtain the radial displacement vector, the raw sensor outputs are first temperature-compensated based on their respective target displacement readings. Then, sensor linearity is corrected, based on their respective temperature-corrected target displacement readings, for instance using a look-up table. In the absence of a radial offset correction, sensors 118 may a) report a smaller mandrel diameter than what is actually present; and b) have a larger error on the small diameter end of the mandrel than the large diameter end of the mandrel. The BD axis offset is the parameter that determines the radial offset correction for sensors 118*c* and 118*d*. Likewise, the AC axis offset is the parameter that determines the radial offset correction for sensors 118*b* and 118*d*. Thus, the mandrel diameter X can be calculated as follows:

$$X = \frac{Kbd \times (Y - Bs - Ds) + Kac \times (L - As - Cs)}{2}$$

where: Y is the fixed distance between the sensor faces; "As," "Bs," "Cs" and "Ds" are the corrected sensor-to-target distances for sensor 118*a*, 118*b*, 118*c* and 118*d*, respectively; $K_{ac}$ and $K_{bd}$ are proportioning coefficients such that $K_{ac}+K_{bd}=1$. The proportioning coefficients are adjusted based on the relative magnitudes of the value of D−B and C−A. For example, if D−B=0, then the mandrel is centered along the AC axis and $K_{ba}=0$ and $K_{ac}=1$. Similarly, if magnitude of D−B≅B−A, then the radial displacement vector angle is ≅45° and $K_{bd}=K_{ac}=½$. The relationship between the proportioning coefficients and the relative magnitudes of D−B and C−A could be based on measured data obtained over time during use. The proportioning coefficients are proportional to the cosine of θ as follows:

$$K_{bd} = \frac{1 + \cos(\theta - 90°)}{2}, \text{ and}$$

-continued $$K_{ac} = 1 - \frac{1 + \cos(\theta - 90°)}{2}.$$

The proportionality formula (an offset cosine) assigns greater weight to the axis which is closest to the center and therefore has had the least radial offset correction. This data set can then be filtered to more accurately determine the mandrel diameter X and, hence mandrel axial displacement Z.

In accordance with other embodiments, the obtained sensor data can be filtered to further refine data used to derive mandrel position. FIGS. 10A-10B depict determination of mandrel diameter X in a quad array. As shown in FIG. 10A, the mandrel cross-section can be radially offset in both orthogonal axes AC and BD. In such an embodiment, the mandrel diameter X can be obtained by selecting those data wherein the distances 97*a*-97*d* between detection portion (or outer surface) of the mandrel 34 and each sensor 118 are equal. Calculating the average distances 97*a*-97*d* across sensor 118*a*-118*d*, respectively, can be used to determine the mandrel diameter X.

Figure 11A:
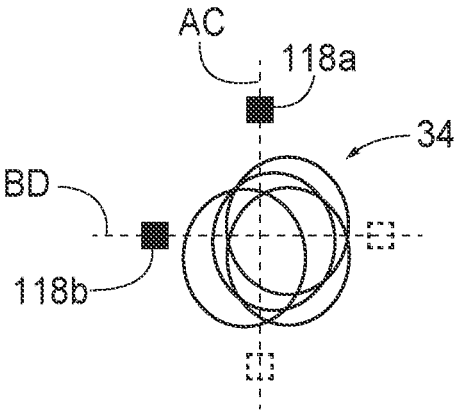
FIGS. 11A-12B are schematic diagrams of an alternative embodiment of an inner member and sensors carried by the sensor housing, illustrating radial displacement of the inner member relative to the sensors.
Figure 11B:
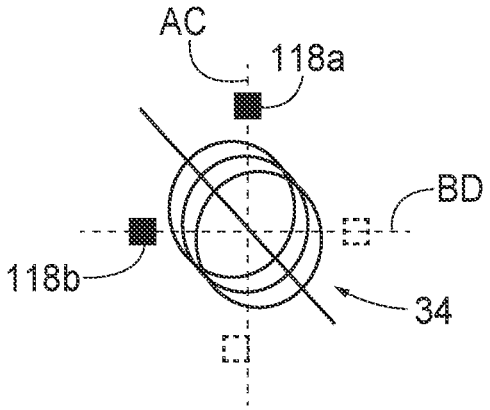

In a two sensor array as shown in FIG. 11A, where two sensors 118 are arranged orthogonal with respect each other, the mandrel diameter X is calculated by first filtering the sensor data set to exclude those sensor distances 97*a*-97*b* among each sensor 118*a* and 118*b* that are unequal. The unequal distance data set is graphically illustrated as shown in FIG. 11B. The mandrel diameter X is then calculated based on the median of filtered subset of distances 97*a*-97*d* that are unequal. While it is possible that the median may show a bias, diameter accuracy is at least 2% when the mandrel becomes decentered by as much as 1 mm. A two sensor array may result when a quad array (as shown in FIGS. 7 and 9A-10B) has lost two sensors. Alternatively, the system may employ only two sensors for reasons of economy. In two sensor array as illustrated in FIG. 11, the sensor measurement axes AC and BD are orthogonal and intersect.

Figure 12A:
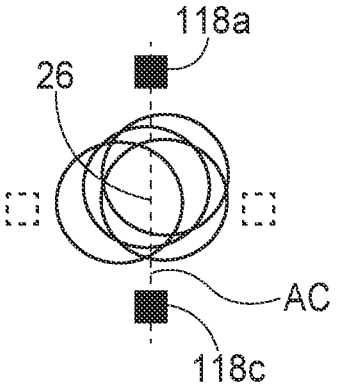
Figure 12B:
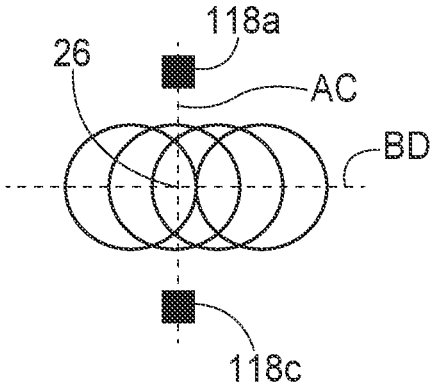
Figure 13:
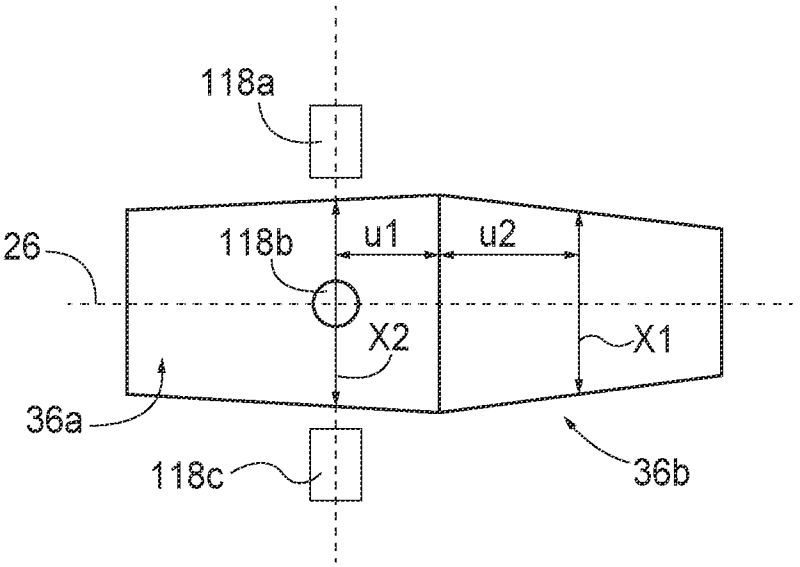
FIG. 13 is a schematic diagram illustrating a side view of an inner member and sensors carried by sensor housing shown in FIGS. 4-7, illustrating an alternative embodiment of an inner member.

In another two sensor array as shown in FIGS. 12A and 12B, two sensors 118 are arranged such that axis AC and BD are coaxial. In such an embodiment, the diameter X of the mandrel diameter is calculated by first filtering the sensor data set to exclude those sensor distances 97*a*-97*b* among each sensor 118*a* and 118*c* that are unequal. The equal distance data set is graphically illustrated as shown in FIG. 12B. The mandrel diameter X is then calculated by selecting those data pairs that indicate closest proximity to the mandrel. Further averaging can be used to refine the data set as shown in FIG. 12B.

Turning to FIG. 13, an embodiment of the present disclosure can utilize a nonlinear mandrel taper. In one embodiment, the mandrel can be tapered at 3 mm/100 mm beginning at the slack position (0 mm) and ending at the mid-point (100 mm), while continuing with a taper of 1 mm/100 mm beginning at the mid-point and extending to the fully compressed position (200 mm). Such a configuration would allow for higher resolution in the range of mandrel travel where it is most useful as well as easing the axial positioning requirements for the sensors 118*a*-118*d*.

As noted above, mandrel position as a function of axial displacement can be derived using other methods. In one such alternative embodiment, axial displacement is determined based on the determined distances of the mandrel at an initial or mechanical zero position, a first or maximum displacement position, and the second or minimum displacement position. The distance 97 is the distance between the sensor face and the detection portion (or outer surface) of the mandrel. In one embodiment, the distance $W_n$ is provided by the equation: $W_n=a+bx+cx^2+dx^3$. Here, n represents the specific sensor 118*a*, 118*b*, 118*c*, 118*d*; a, b, and c are derived cubic coefficients for each sensor; and x is the sensor output in volts as the mandrel 34 enters the detection range of the respective sensor. The temperate coefficient $T_n$ for each sensor is given by the following equation: $T_n=a+b(Temp)+c(Temp)^2$, where n represents the specific sensor 118*a*, 118*b*, 118*c*, 118*d*; a, b, and c are derived quadratic coefficients for each sensor; and Temp is measured temperature.

In order to determine the distance W at the mechanical zero position, the method includes a) accessing the cubic coefficients stored as machine constants in memory of the controller 230, and b) accessing temperature-compensation machine constants stored as machine constants in memory of the controller 230. Next, the processor then determines the temperature coefficients for each sensor at an initial or mechanical zero position. Based on the temperature coefficients, the processor determines the linearized true distance W at each sensor at the mechanical zero position. Next, the processor utilizes a summation calculation for the mechanical zero position, whereby the distances W, 97*a*-97*d* for each sensor 118*a*-118*d*, respectively, are added together. It should be appreciated that the processor can apply any number of methodologies to determine distances between sensor faces and mandrel. For instance, using a hypotenuse method, the distances W is based on the square root of the squares of the sums of the distances along axes AC and BD. In another example using an average method, the average distance W among each sensor 118*a*-118*d* is determined. In still another alternative, using a "geometric mean" method, the distances W are determined based on square root of the products of the distance W along each axis AC and BD.

When the mandrel is at a first or maximum displacement position, the processor determines linearized distance for each sensor at the maximum displacement position, based in part of the temperature compensation and cubic coefficients. The processor then sums all the distances for each sensor to determine the true distance between the sensor face and mandrel when the mandrel is at maximum displacement position.

When the mandrel is at a second or minimum displacement position, the processor determines linearized distance for each sensor at the minimum displacement position, based on part of the temperature compensation and cubic coefficients. The processor then sums all the distances for each sensor to determine the true distance between the sensor face and mandrel when the mandrel is at the minimum displacement position.

Based on the determined distances at mechanical zero position, the first displacement position, and the second displacement position, the processor determines mandrel axial displacement. In one example, the mandrel displacement is a derived linear equation whereby distance W at the mechanical zero position is the intercept and the determined distances W at the minimum and maximum displacement positions is the slope of the linear equation. The processor can then determine axial displacement for any number of determined distances as the mandrel is axially displaced.

Regardless of the specific method used to determine mandrel diameter and/or axial displacement of the mandrel, the control system 200 may be used.

Furthermore the monitoring system is configured to modify or adjust the function used to determine distance based on the sensor array: quad array, dual sensor array, etc.

Figure 15:
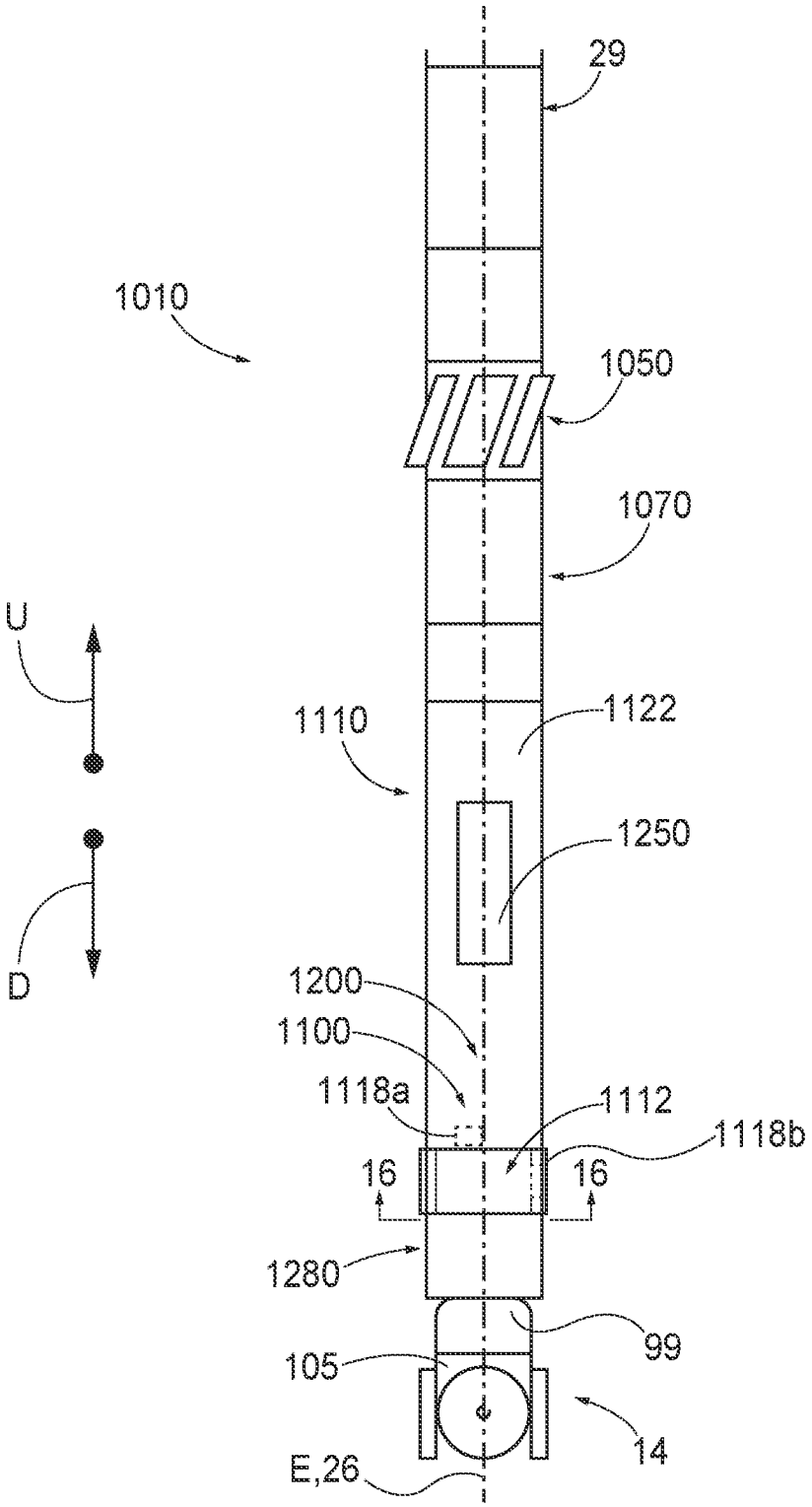
FIG. 15 is a side view of a portion of a bottomhole assembly of a drill string in the drilling system shown in FIG. 1, illustrating a rotary steerable motor system including sensors configured to detect motion.

FIGS. 15-18 depict another embodiment of the present disclosure of utilizing a proximity sensor to determine tool component position. FIG. 15 illustrates a drill string with a directional tool. As illustrated, the directional tool is a rotary steerable motor (RSM) system 1010 including one more proximity sensors 1118*a* and 1118*b*. The RSM system 1010 may include a drilling motor 29 operatively coupled to a guidance module 1110, and a control system 1200 including at least one controller, such as a master controller 1250. The drill motor 29 is coupled to a drive shaft 99 that is in turn coupled to the drill bit 14. The RSM system control system 1200 is configured to operate the module 1110 as determined according to the well plan, and, as needed, cause the guidance module 1110 to direct the drill bit 14 toward a predetermined drilling direction. The RSM system 1010 includes stabilizers 1050 and compensation assemblies 1070 (and 1280).

Figure 16:
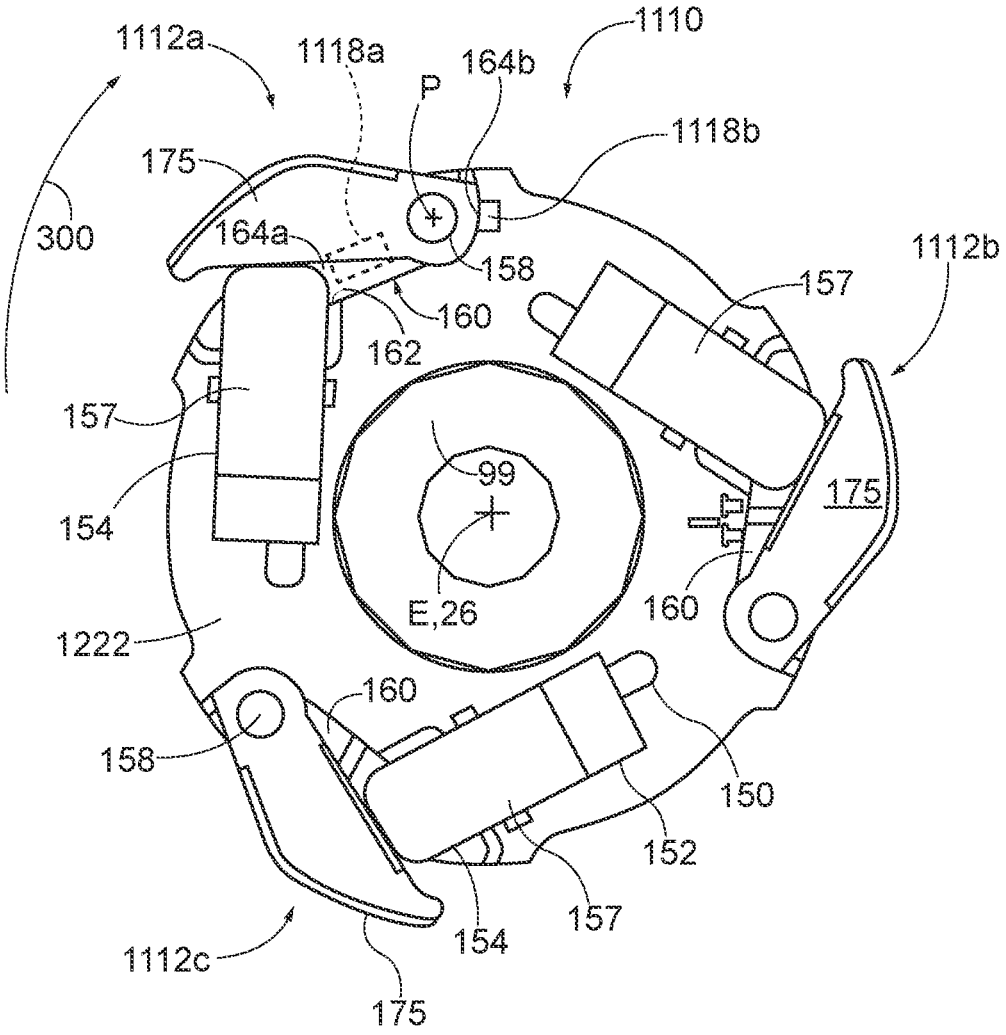
FIG. 16 is a cross sectional view of the rotary steerable motor system shown in FIG. 15, taken through the line 16-16 of FIG. 15.

As shown in FIGS. 15 and 16, to guide the drilling direction, the RSM system 1010 causes one or more of the actuation assemblies 1112 to extend outwardly to contact the borehole wall to cause a directional change or adjustment of the drill bit 14. The guidance module 1110 can include a tool body 1122, a number of recesses 160 defined by the tool body 1122, a plurality of actuating assemblies 1112 each including an arm or moveable pad 175, a piston 157 housed in bank 154, and sensor modules 1118*a*, 1118*b* positioned in the tool body 1122 proximate recess 160. The actuating assemblies 1112 includes an arm or moveable pad 175, and a piston 157 housed in bank 154. The arms 175 are selectively movable from a retracted position, where the arm is disposed toward a central axis 26 of the rotary steerable motor system, to an extended position, where the arm is disposed outwardly from the retracted position away from the central axis. The arm 175 pivots about pivot 158 in response to axial movement of piston 157 in bank 154. The pivot 158 defines a pivot axis P that is parallel to the central axis 26. Pressure proximate bank 154, controlled by the control system 1200, can cause the piston 157 to advance outwardly or retract. The sensor module 1118*a*, 1118*b* can be positioned near the recess 160 so that if the arm is retracted, the arm 175 moves within the detectable range of the sensor module 1118*a*, 1118*b*. The sensor module 1118*a*, 1118*b* could be positioned at any number of locations along the recess 160 to detect a position of the arm.

The tool body 1122 defines a side wall 164 that extends perpendicularly to the central axis 26 and intersects an interior wall 162. Together the interior wall 162 and side wall 164 define the recess 160. The side wall 164 includes at least a first side wall portion 164*a* and a second side wall portion 164*b* which are offset with respect to each other. The first wall portion 164*a* faces a side of the arm 1112 such that the pivot axis P of the arm 1112 is orthogonal to the first wall portion 164*a*. The second wall portion 164*b* faces an end of the arm 1112 so that the pivot axis P of the arm 1112 is parallel to the wall portion 164*b*. Each wall portion 164*a* and 164*b* can include a chamber (not number) that houses respective sensor modules 1118*a* and 1118*b*. As illustrated, the sensor 1118*a* can be positioned on first wall portion 164*a* wall of recess 160 and sensor module 1118*b* can be positioned on second wall portion 164*b* wall of recess 160. Two sensor modules are illustrated. It should be appreciated that one sensor module 1118 can be used for each respective actuating assembly 1112. Alternatively, multiple sensor modules 1118 can be used for each actuating assembly 1112.

Furthermore, it may be advantageous to employ multiple sensor modules along same wall portion. For example, two or more sensors modules 1118 can be disposed along wall portion 164*b*.

The sensor modules 1118 are substantially similar to the sensor module 118 described above, the difference being the housing which carries the sensor module is adapted for use with the RSM tool. A rotary steerable motor system, whereby the drilling motor 29 powers the guidance module, is described above. However, the sensor modules 1118 may be used in a rotary steerable system whereby a power source independent of the drilling motor 29 power the guidance module and related components of the steering tool.

Embodiments of the present disclosure include proximity sensors used in compensation assemblies. Compensation assemblies can be used to compensate for variations in pressure during the drilling. For instance, as a drill bit 14 penetrates further into the earthen formation, the pressure of the drilling mud increases. As with the exemplary RSM system 1010 illustrated, operation of the movable pads are dependent upon flow of the drilling mud through the motor 29. Compensation systems allow for pressure of operational fluids, such as oil in hydraulic circuit, to vary in proportion to the variance in drilling mud pressure.

Figure 17:
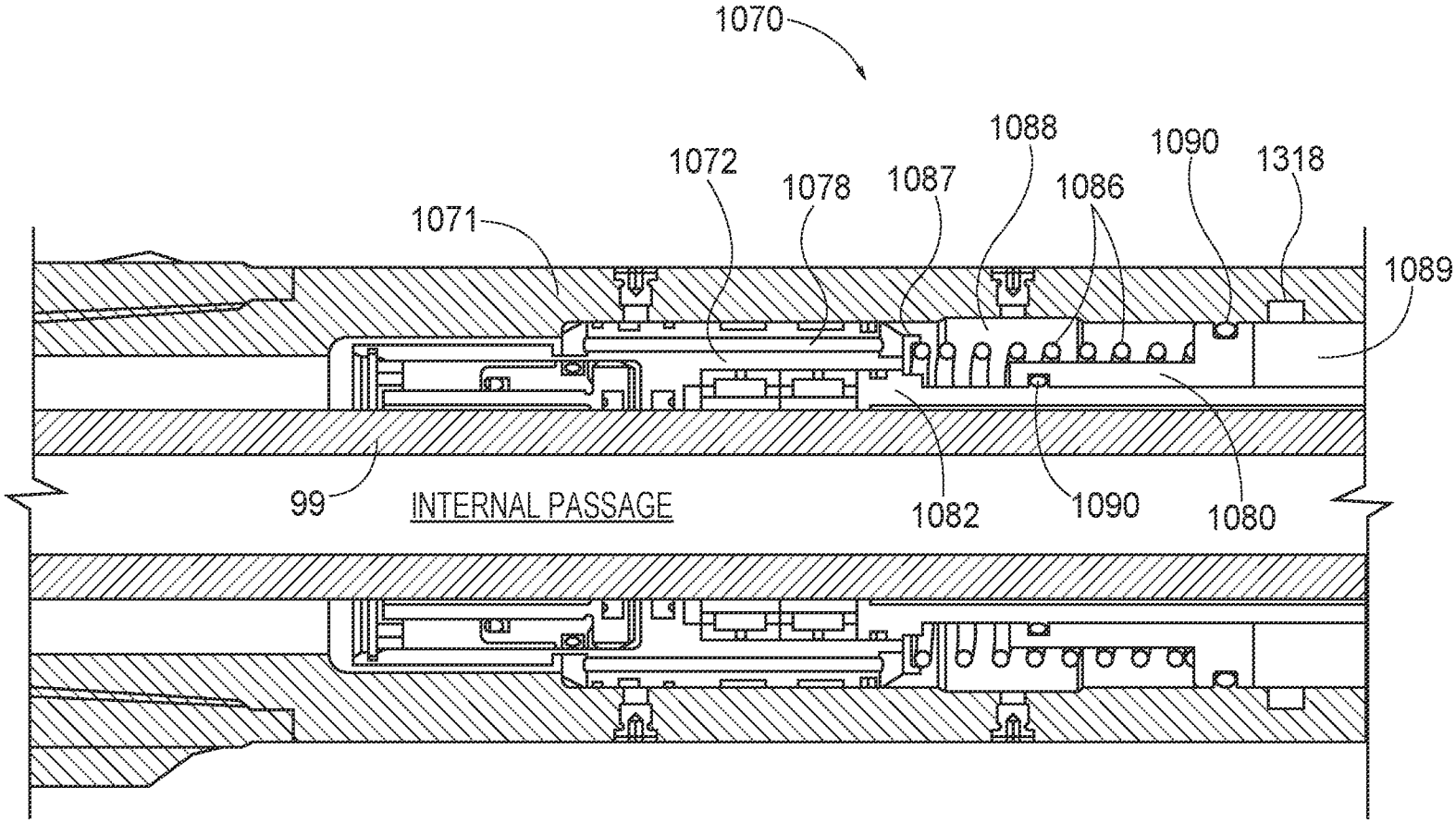
FIG. 17 is a side sectional view of the rotary steerable motor system shown in FIG. 15, illustrating another portion of the rotary steerable motor system shown in FIG. 15.

As illustrated in FIG. 17, which is a sectional view of an RSM system, sensors may be used in a compensation assembly 1070 to determine the position of certain components of the assembly 1070. As illustrated, the compensation assembly 1070 includes an outer housing 1071, bearing support 1072 secured to an inner surface of housing 1071, a piston 1080, and a piston shaft 1082. An up-hole end of the piston shaft 1082 is positioned within the bearing support 1072. A down-hole end of the piston shaft 1082 is supported by a mounting ring 84 (not shown in FIG. 17) secured to an inner surface of the housing 1071. The piston 1080 is moveable relative to the shaft 1082. In accordance with the illustrated embodiment, the compensation assembly 1070 includes a sensor module 1318 positioned downhole with respect to the lowermost end of the piston 1080. The sensor module 1318 is configured to detect the presence of the piston 1080 within its detection range, which can be indicative of an undesired pressure differential between the oil in the hydraulic circuit and the drilling mud, as will be further detailed below.

Referring to FIG. 17, the housing 1071, bearing support 1072, the piston shaft 1082, and the up-hole end of the piston 1080 define an internal volume 1088. The volume 1088 receives drilling mud, at bore pressure, from the volume 1089 by way of the passages 1078 formed in the bearing support 1072. The piston 1080 defines the down-hole end of the internal volume 1088. The up-hole face of the piston 1080 therefore is exposed to drilling mud at annulus pressure. Furthermore, the housing 1071, the piston shaft 1082, the upper drive shaft 1082, and the down-hole end of the piston 1080 define an internal volume 1089 down hole of the piston 1080 (see FIGS. 4A and 5). The volume 1089 is filled with oil, and forms part of the hydraulic circuit within the system 1110. The down-hole face of the piston 1080 therefore is exposed to the oil in the hydraulic circuit. Various O-ring seals 1090 are positioned around the inner and outer circumference of the of piston 1080 to isolate the volume 1089 from the volume 1088, and thereby reduce the potential for contamination of the oil by the drilling mud. Because the piston 1080 can move axially in relation to the piston shaft 1082, the piston 1080 therefore can raise or lower the pressure of the oil in the volume 1089, in response to a pressure differential between the drilling mud and the oil. In particular, the combined force of the drilling mud and the spring 1086 on the piston 1080 urges the piston 1080 in the down-hole direction, thereby increasing the pressure of the oil, until the force of the oil on the piston 1080 is approximately equal to the combined, opposing force of the drilling mud and the spring 1086 on the piston 1080. The additional force provided by the spring 1086 helps to ensure that the pressure of the oil in the hydraulic circuit is higher than the pressure of the drilling mud, thereby reducing the potential for infiltration of the drilling mud into the oil.

As noted above, the piston 1080 compensates for variations in the pressure of the drilling mud during drilling operations. For instance, as the pressure of the drilling mud can vary with the depth of the system 1110 within the bore. The piston 1080 causes the pressure of the oil in the hydraulic circuit to vary proportionately with changes in the pressure of the drilling mud, so that the pressure of the oil remains higher than the pressure of the drilling mud.

In the embodiment illustrated, in the event that the down-hole end of the piston 1080 moves into the detection range of the sensor module 1118*a*, 1118*b*, the processor can send a warning signal to the surface control system (via telemetry) that oil volume at compensation assembly 1070 is approaching unsafe levels. This can permit the operator to take corrective action to reduce build angles, or end the run early, to avert possible tool failure.

Figure 18:
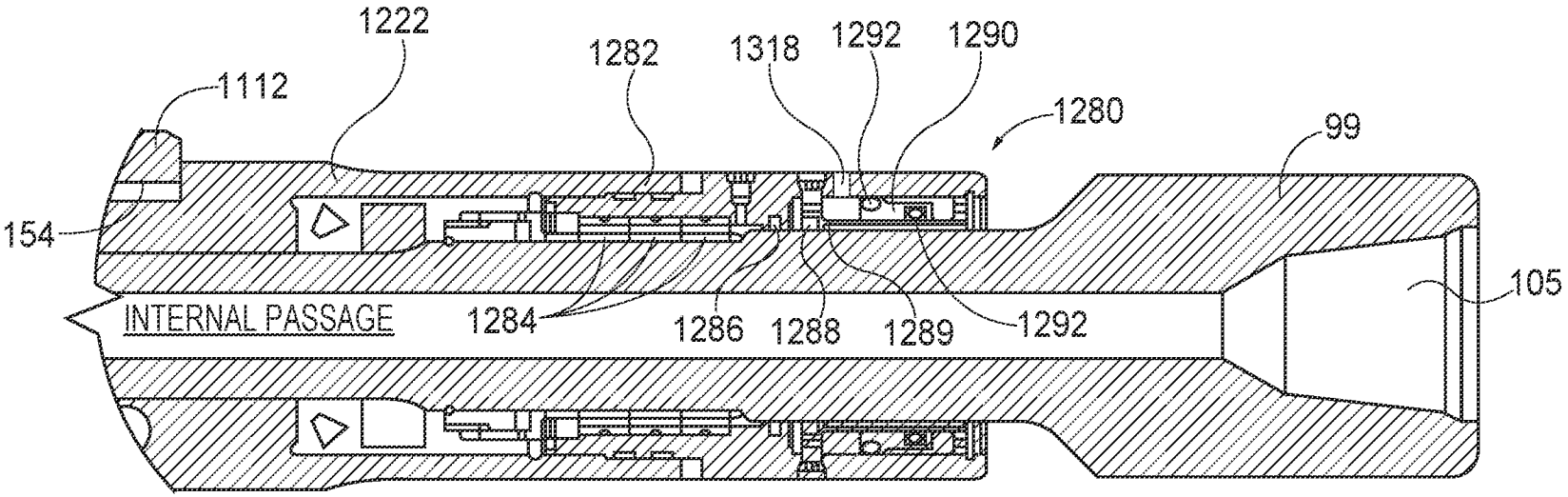
FIG. 18 is a side sectional view of the rotary steerable motor system shown in FIG. 15, illustrating a downhole portion of the rotary steerable motor system shown in FIG. 15 adjacent to a bit box.

The system 1010 also comprises a lower seal bearing pack assembly 1280 (see FIG. 18). The assembly 1280 comprises a housing 1282. The housing 1282 is secured to the housing 1122 of the guidance module 1110 by a suitable means such as a threaded connection, so that the housing 1282 rotates with the housing 1122. The housing 1282 thus forms part of the drill collar. The lower drive shaft 99 extends through the housing 1282. The assembly 1280 also includes three radial bearings 1284 for substantially centering the lower drive shaft 99 within the housing 1282. The bearings 1284 are lubricated by the oil from the first hydraulic circuit. The oil reaches the bearing 1284 by way of various passages and clearances formed in the guidance module 100 and other components of the system 1010.

The assembly 1280 also comprises a first and a second seal 1286, 1288. The first and second seals 1286, 1288 can be, for example, rotary shaft lip seals or rotary shaft face seals. The first and second seals 1286, 1288 are positioned around the lower drive shaft 99. The first seal 1286 is located within an annulus formed in the housing 1282. An up-hole end of the first seal 1286 is exposed to the oil used to lubricate the bearings 1284, i.e., the oil in the first hydraulic circuit. An up-hole end of the first seal 1286 is exposed to oil contained within a fourth hydraulic circuit. The second seal 1288 substantially isolates the oil in the first hydraulic circuit from the oil in the fourth hydraulic circuit. The second seal 1288 is located within an annulus formed in a piston shaft 1289. The piston shaft 1289 is positioned within the housing 1282. An up-hole end of the second seal 1288 is exposed to the oil in the fourth hydraulic circuit. A down-hole end of the second seal 1288 is exposed to drilling mud, as annulus pressure. The second seal 1288 substantially isolates the oil from the drilling mud.

A piston 1290 is positioned around the piston shaft 1289, so that the piston 1290 can translate axially in relation to the piston shaft 1289. An up-hole face of the piston 1290 is exposed to the oil in the hydraulic circuit. A down-hole face of the piston 1290 is exposed to the drilling mud in the annular passage 19 formed between the drill collar 14 and the surface of the bore 2. O-ring seals 1292 are positioned around the inner and outer circumference of the of piston 1290. The O-ring seals 1292 substantially isolate the oil from the drilling mud, and thereby reduce the potential for contamination of the oil by the drilling mud.

As the piston 1290 slides axially, the sensor 1318 can detect when the piston 1290 moves within its detectable range. Because the distance between the piston 1290 and sensor 1310 when the system is at rest, i.e. not operating, is known, detection of the piston 1290 by the sensor 1318 can indicate advancement of the piston 1290 within a predetermined threshold. For instance, as the oil pressure in the chamber decreases, the piston 1290 advances upwardly. Decreasing pressure and associated advancement of the piston 1290 can be indicative of pressure or volume loss and possible seal failure if the advancement is more than expected or desired during normal drilling operations. Accordingly, detection by sensor 1318 of the piston 1290 can be used to alarm the operator that failure is proximate in time or imminent. In this regard, the sensor 1318 can be used to create an early warning signal.

The RSM system 1010 as illustrated is similar to the RSM system described in U.S. Pat. No. 7,389,830 (the 830 patent), the entire contents of which are incorporated by reference into the present disclosure. It should be appreciated, however, the 830 patent describes an exemplary RSM system 10. The present disclosure can be used with variations and/or alternate configurations of the RSM system described in the 830 patent. For instance, the sensors may be used with a rotary steerable tool or any other type of directional drilling tool.

In the embodiment illustrated, in the event that the downhole end of the piston 1290 moves into the detection range of the sensor module 1318, the processor can send a warning signal to the surface control system (via telemetry) that mud pressure at compensation assembly 70 is approaching unsafe levels. This can permit the operator to take corrective action to end the run prematurely and avert possible tool failure.

Figure 19:
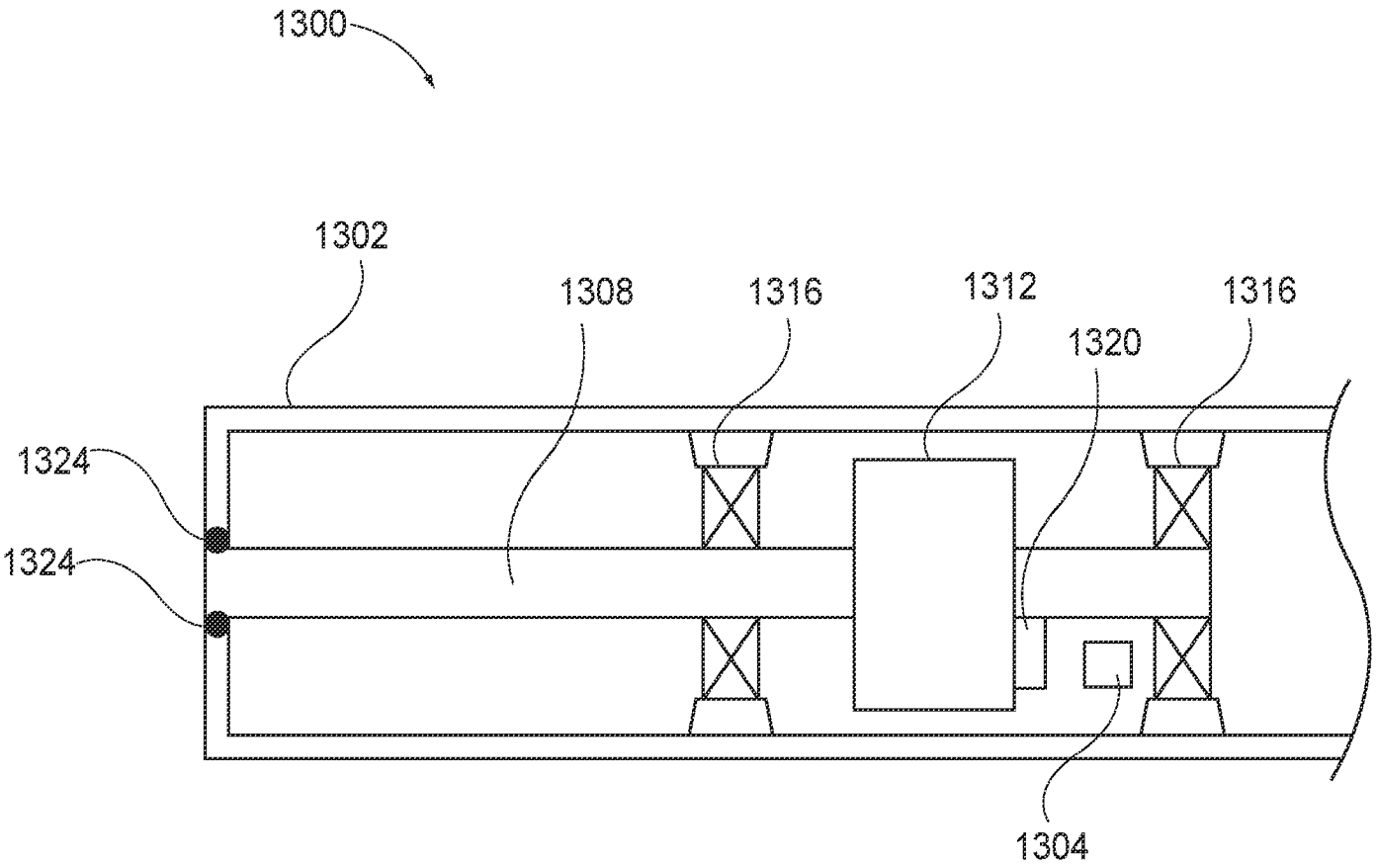
FIG. 19 is a schematic diagram illustrating an alternative embodiment of the present disclosure.

FIG. 19 depicts another embodiment of the present disclosure that includes a system 1300 configured to determine torsional acceleration of a component of a drill string. The system 1300 includes a housing 1302, at least one sensor module 1304, a torsional spring 1308, a reaction mass 1312 having a high moment inertia, and one or more radial bearings 1316. The housing 1302 may be coupled to the torsional spring 1308 via one or more rigid connections 1324. As shown, the torsional spring 1308 is at least partially positioned inside the housing proximate to an off-center target 1320. The sensor module 1304 is configured to obtain data indicative of acceleration. The reaction mass 1312 is coupled to the torsional spring and is also positioned in the housing. The system 1300 may further include a computer processor (not depicted) configured to, in response to information from the sensor module 1304 and the reaction mass 1312, determine the torsional acceleration of the housing or component of the drill string. The sensor module 1304 may include a damping means to prevent oscillations in the sensor module 1304. The sensor module 1304 may include a proximity sensor, such as an eddy current sensor.

What is claimed:

1. A tool assembly configured to be carried by a drill string that is configured to define a borehole in an earthen formation during a drilling operation, the tool assembly comprising:

a first member;

a second member that is moveable relative to the first member during the drilling operation;

a sensor module coupled to the first member, the sensor module including at least one proximity sensor spaced from the second member so that the second member is within a detectable range of the at least one proximity sensor, wherein the at least one proximity sensor is configured to detect information indicative of movement of the second member relative to the first member; and a downhole computer processor carried by either the first member or the second member, the downhole computer processor in electronic communication with the at least one proximity sensor, the downhole computer processor configured to, in response to the information indicative of the movement of the second member relative to the first member, determine a position of the second member relative to the first member;

wherein the downhole computer processor is configured to compensate measured distance between the at least one proximity sensor and the second member based on radial offset, a measured pressure, and a measured temperature proximate to the sensor module to provide a compensated distance between the at least one proximity sensor and the second member, thereby improving accuracy of the determined position of the second member relative to the first member.

2. The tool assembly of claim 1, further comprising a temperature sensor configured to measure the temperature proximate to the sensor module.

3. The tool assembly of claim 1, further comprising a pressure sensor configured to measure the pressure proximate to the sensor module.

4. The tool assembly of claim 1, wherein the at least one proximity sensor is operable when exposed to a temperature range between approximately 100 degrees centigrade and approximately 200 degrees centigrade.

5. The tool assembly of claim 1, wherein the at least one proximity sensor is operable when exposed to at least 175 degrees centigrade.

6. The tool assembly of claim 1, wherein the at least one proximity sensor is pressure rated up to 1700 BAR.

7. The tool assembly of claim 1, wherein the at least one proximity sensor is pressure rated up to 1000 BAR.

8. The tool assembly of claim 1, wherein the at least one proximity sensor is operable when subject to pressures between approximately 1000 BAR and approximately 1700 BAR.

9. The tool assembly of claim 1, wherein frequency response of the at least one proximity sensor is at least 1 Khz.

10. The tool assembly of claim 1, wherein the first member and the second member are part of a vibration damping system.

11. The tool assembly of claim 1, wherein the first member and the second member are part of a rotary steerable system, wherein the first member is a housing and the second member is a moveable pad that extends out from the housing.

12. The tool assembly of claim 1, wherein the first member and the second member are part of a compensation system.

13. The tool assembly of claim 1, wherein the at least one proximity sensor is an eddy current sensor.

14. The tool assembly of claim 1, wherein the at least one proximity sensor is positioned along a sensor axis that intersects an outer surface of the second member, and the downhole computer processor is configured to determine a distance from the at least one proximity sensor to the outer surface of the second member along the sensor axis.

15. The tool assembly of claim 1, wherein the at least one proximity sensor includes a first proximity sensor disposed along a first sensor axis and a second proximity sensor disposed along a second sensor axis that is perpendicular to and intersects the first sensor axis, wherein the first sensor axis and the second sensor axis intersect and are perpendicular to a central axis of the tool assembly.

16. The tool assembly of claim 1, wherein the at least one proximity sensor includes a first proximity sensor disposed along a first sensor axis, a second proximity sensor disposed along a second sensor axis, and a third proximity sensor that is disposed along a third sensor axis, wherein the first sensor axis, the second sensor axis, and the third sensor axis intersect.

17. The tool assembly of claim 1, wherein the sensor module includes a housing having a first end, a second end spaced from the first end along a central axis of the tool assembly, and a passage that extends from the first end to the second end along the central axis, and the at least one proximity sensor has a nominal detecting range that extends into the passage toward the central axis.

18. The tool assembly of claim 17, wherein the first member includes an outer tubular body having a passage that extends along the axial direction, and the second member is a mandrel moveably disposed within the passage along the axial direction.

19. A tool assembly for a drill string that is configured to define a borehole in an earthen formation during a drilling operation, the tool assembly comprising:

a first member elongated along a central axis;

a second member that is moveable relative to the first member during the drilling operation, wherein the second member is moveable in response to vibration of a drill bit coupled to a downhole end of the drill string;

a sensor module coupled to the first member, the sensor module including a set of proximity sensors spaced apart from the second member in a direction perpendicular to the central axis, each proximity sensor configured to detect information indicative of a measured distance between the proximity sensor and the second member;

a temperature sensor configured to measure temperature proximate to the sensor module;

a pressure sensor configured to measure pressure proximate to the sensor module; and a downhole computer processor configured to, in response to the information indicative of the measured distance between the set of proximity sensors and the second member, the temperature, and the pressure, determine a position of the second member relative to the first member; and wherein the downhole computer processor is configured to compensate the measured distance between each proximity sensor and the second member based on the measured pressure and the measured temperature proximate to the sensor module to provide a compensated distance between each proximity sensor and the second member thereby improving accuracy of the determined position of the second member relative to the first member.

20. The tool assembly of claim 19, wherein the set of proximity sensors are positioned along respective sensor axes that intersect an outer surface of the second member, and the downhole computer processor is configured to determine the measured distance from each sensor to the outer surface of the second member along the respective sensor axes.

21. The tool assembly of claim 19, wherein a first pair of proximity sensors are spaced apart along a first sensor axis that is perpendicular to and intersects the central axis, and a second pair of proximity sensors are spaced apart along a second sensor axis that intersects and is perpendicular to the first sensor axis.

22. The tool assembly of claim 19, wherein the set of proximity sensors is a first proximity sensor disposed along a first sensor axis, and a second proximity sensor disposed along a second sensor axis that is perpendicular to and intersects the first sensor axis, wherein the first sensor axis and the second sensor axis intersect and are perpendicular to the central axis.

23. The tool assembly of claim 19, wherein the set of proximity sensors is a first proximity sensor disposed along a first sensor axis, a second proximity sensor disposed along a second sensor axis, and a third proximity sensor that is disposed along a third sensor axis, wherein the first sensor axis, the second sensor axis and the third sensor axis intersect.

24. The tool assembly of claim 19, wherein the sensor module includes a housing having a first end, a second end spaced from the first end along the central axis, and a passage that extends from the first end to the second end along the central axis, and each sensor has a nominal detecting range that extends into the passage toward the central axis.

25. The tool assembly of claim 24, wherein the first member includes an outer tubular body having a passage that extends along an axial direction, and the second member is a mandrel moveably disposed within the passage along the axial direction.

26. The tool assembly of claim 25, wherein the downhole computer processor is configured to, in response to detection of an outer surface of an inner member when the inner member is in a first position, determine a first cross-sectional dimension of the inner member, the first cross-sectional dimension being aligned with the set of proximity sensors when the inner member is in the first position.

27. The tool assembly of claim 26, wherein the downhole computer processor is further configured to, in response to the detection of the outer surface of the inner member when the inner member is in a second position that is different than the first position along the axial direction, determine 1) a second cross-sectional dimension of the inner member, the second cross-sectional dimension being aligned with the set of proximity sensors when the inner member is in the second position, and 2) displacement of the inner member based on a predetermined distance between the first cross-sectional dimension and the second cross-sectional dimension.

28. A method for determining a relative position of components of a downhole tool along a drill string configured to drill a borehole into an earthen formation, the method comprising:

detecting, via a plurality of proximity sensors mounted to a first component of the downhole tool, a second component of the downhole tool within a detection range of the plurality of proximity sensors;

determining, via a downhole computer processor in electronic communication with the plurality of proximity sensors, a distance from each proximity sensor to a detected portion of the second component; and determining, via the downhole computer processor, a position of the second component relative to the first component based on the distance between the plurality of proximity sensors and the detected portion of the second component and compensating the distance between the plurality of proximity sensors and the detected portion of the second component based on at least one of a measured pressure and a measured temperature proximate to the plurality of proximity sensors, thereby improving accuracy of the determined position of the second component relative to the first component.

29. The method of claim 28, wherein the first component is a casing defining a passage, and the second component is a mandrel disposed in the passage, and the detected portion is an outer surface of the mandrel.

30. The method of claim 28, further comprising measuring the temperature proximate to the plurality of proximity sensors.

31. The method of claim 30, further comprising measuring the pressure proximate to the plurality of proximity sensors.

32. The method of claim 28, wherein determining the position of the second component includes averaging the distance from each proximity sensor to respective detected portions of the second component.

33. The method of claim 28, wherein determining the position of the second component includes summing the distance from each proximity sensor to respective detected portions of the second component.

34. The method of claim 28, wherein the detected portion of the second component is an outer surface of the second component.

35. The method of claim 28, wherein the detected portion of the second component is a central axis of the second component.

36. The method of claim 28, further comprising:

determining if less than all of the plurality of proximity sensors have obtained detection values outside of their respective nominal detection ranges; and if less than all of the plurality of proximity sensors have obtained the detection values outside of their respective nominal detection ranges, adjusting the determination of the position of the second component based on locations of the plurality of proximity sensors that obtained the detection values within their respective nominal detection ranges.

37. The method of claim 28, wherein the plurality of proximity sensors are four sensors arranged along two axes that are perpendicular to and intersect each other, and the method includes:

determining if less than the four sensors obtained detection values outside of their respective nominal detection ranges; and if less than the four sensors obtained the detection values outside of their respective nominal detection ranges, adjusting the determination of the position of the second component based on locations of the four sensors that obtained the detection values within their respective nominal detection ranges.

38. The method of claim 28, wherein the plurality of proximity sensors are four sensors, and the method includes:

determining if three of the four sensors obtained detection values outside of their respective nominal detection ranges; and if less than the three of the four sensors obtained the detection values outside of their respective nominal detection ranges, adjusting the determination of the position of the second component based on relative locations of two sensors that obtained the detection values within their respective nominal detection ranges.

39. The method of claim 28, further comprising:

determining if two of four sensors of the plurality of proximity sensors obtained detection values outside of their respective nominal detection ranges; and if less than the two of the four sensors obtained the detection values outside of their respective nominal detection ranges, adjusting the determination of the position of the second component based on relative locations of two sensors that obtained the detection values within their respective nominal detection ranges.

40. The method of claim 39, wherein the two sensors are arranged along a common axis and face each other, wherein determining the position of the second component includes averaging the distance from each proximity sensor to a respective detected portion of the second component.

41. The method of claim 39, wherein the two sensors are arranged along a first axis and a second axis that are perpendicular to and intersect each other, and determining the position of the second component includes summing the distance from each proximity sensor to a respective detected portion of the second component.

42. The method of claim 28, wherein determining the position of the second component relative to the first component is based on at least one of the plurality of proximity sensors obtaining a detection value within a nominal detection range.

43. The method of claim 42, wherein the plurality of proximity sensors are four sensors, and determining the position of the second component relative to the first component is based on at least three sensors obtaining detection values within their respective nominal detection ranges.

44. The method of claim 28, wherein the plurality of proximity sensors are four sensors, and determining the position of the second component relative to the first component is based on at least two sensors obtaining detection values within their respective nominal detection ranges.

45. The method of claim 28, wherein the plurality of proximity sensors are three sensors, and determining the position of the second component relative to the first component is based on at least two of the three sensors obtaining detection values within their respective nominal detection ranges.

* * * * *